US011937685B2

(12) United States Patent
Rogers et al.

(10) Patent No.: US 11,937,685 B2
(45) Date of Patent: Mar. 26, 2024

(54) BACKPACK

(71) Applicant: YETI Coolers, LLC, Austin, TX (US)

(72) Inventors: Kyle Edward Rogers, Austin, TX (US); Jeffrey Charles Munie, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

(21) Appl. No.: 16/959,955

(22) PCT Filed: Dec. 20, 2018

(86) PCT No.: PCT/US2018/066679
§ 371 (c)(1),
(2) Date: Jul. 2, 2020

(87) PCT Pub. No.: WO2019/135922
PCT Pub. Date: Jul. 11, 2019

(65) Prior Publication Data

US 2021/0068519 A1 Mar. 11, 2021

Related U.S. Application Data

(60) Provisional application No. 62/613,795, filed on Jan. 5, 2018.

(51) Int. Cl.
*A45F 3/04* (2006.01)
*A45C 13/10* (2006.01)

(52) U.S. Cl.
CPC ..... *A45F 3/04* (2013.01); *A45C 13/103* (2013.01); *A45C 13/1069* (2013.01)

(58) Field of Classification Search
CPC ..... A45F 3/04; A45C 13/103; A45C 13/1069; A45C 7/00; A45C 11/20; A45C 13/008; A45C 11/22; A45C 3/10; F25D 3/08; Y10S 206/811
USPC ..... 224/153; 383/84–85, 88–91
See application file for complete search history.

(56) References Cited

U.S. PATENT DOCUMENTS 5,908,245 A 6/1999 Bost et al.
6,237,776 B1 * 5/2001 Mogil ..... A45F 3/02 150/112
6,722,784 B2 4/2004 Breil, Jr.
10,954,055 B2 3/2021 Rogers et al.
(Continued)

FOREIGN PATENT DOCUMENTS

CA 2354505 A1 1/2003
CN 101168090 A 4/2008
(Continued)

OTHER PUBLICATIONS

May 6, 2019—(WO) International Search Report and Written Opinion—App. No. PCT/US2018/066679.
(Continued)

*Primary Examiner* — Nathan J Newhouse
*Assistant Examiner* — Matthew T Theis
(74) *Attorney, Agent, or Firm* — Banner & Witcoff, Ltd.

(57) ABSTRACT

A backpack that has a front pocket with an outer shell with an opening that is sealed by a closure mechanism. The closure mechanism can include magnetic strips that are configured to partially or wholly seal the opening, and have hinged couplings of the magnetic strips to internal surfaces of the container.

11 Claims, 29 Drawing Sheets

(56) References Cited

U.S. PATENT DOCUMENTS

| | | | | |
|---|---|---|---|---|
| 11,229,268 | B2 | 1/2022 | Munie et al. | |
| 2002/0038811 | A1 | 4/2002 | Vigny | |
| 2003/0116461 | A1 | 6/2003 | Colloton | |
| 2004/0238303 | A1 | 12/2004 | Hafif | |
| 2006/0072857 | A1 | 4/2006 | Revels | |
| 2006/0090976 | A1 | 5/2006 | Repke et al. | |
| 2007/0278234 | A1* | 12/2007 | Mogil | B65D 81/38 220/592.2 |
| 2008/0037907 | A1 | 2/2008 | Suskind | |
| 2008/0179364 | A1 | 7/2008 | Thatcher | |
| 2011/0036473 | A1 | 2/2011 | Chan et al. | |
| 2011/0204114 | A1 | 8/2011 | Miller | |
| 2013/0061431 | A1 | 3/2013 | Naftali et al. | |
| 2013/0243354 | A1* | 9/2013 | Lytle | A45C 3/00 383/59 |
| 2015/0225164 | A1 | 8/2015 | Seiders et al. | |
| 2016/0005812 | A1 | 1/2016 | Hsu et al. | |
| 2016/0221722 | A1 | 8/2016 | Burke et al. | |
| 2017/0006655 | A1 | 1/2017 | Hamada | |
| 2017/0280937 | A1 | 10/2017 | Mogil et al. | |
| 2018/0252458 | A1 | 9/2018 | Furneaux et al. | |

FOREIGN PATENT DOCUMENTS

| | | | |
|---|---|---|---|
| CN | 203435847 | U | 2/2014 |
| CN | 205053143 | U | 3/2016 |
| CN | 105686234 | A | 6/2016 |
| CN | 205512896 | U | 8/2016 |
| CN | 206006212 | U | 3/2017 |
| CN | 107028310 | A | 8/2017 |
| EP | 1864916 | A1 | 12/2007 |
| JP | S49112604 | U | 9/1974 |
| JP | S60121819 | U | 8/1985 |
| JP | H05056809 | A | 3/1993 |
| JP | 3003213 | U | 10/1994 |
| JP | 2011036401 | A | 2/2011 |
| JP | 2011121631 | A | 6/2011 |
| WO | 2017136754 | A1 | 8/2017 |
| WO | 2018165426 | A1 | 9/2018 |

OTHER PUBLICATIONS

Sep. 24, 2021—(EP) Examiner Report—App. No. 18833791.9.
Nov. 29, 2021—(CN) First Office Actioon—App. No. 201880089325.8.
Dec. 23, 2021—(EP) Article 94(3) Communication—App. No. 18833791.9.
Dec. 27, 2022—(JP) Office Action—App. No. 2020537244.
Jun. 7, 2023—(JP) Decision of Rejection—App. No. 2020537244.
Jun. 28, 2023—(CN) Office Action—App. No. 202210897520.1.
Jun. 19, 2018—(WO) ISR & WO—App. No. PCT/US2018/21546.
May 6, 2020—(WO) ISR & WO—App. No. PCT/US20/21513.
Apr. 30, 2020—(WO) ISR & WO—App. No. PCT/US20/21519.
Oct. 17, 2023—(AU) Examination Report 1—App. No. 2018399588.
Nov. 20, 2023—(JP) Notice of Reconsideration—App. No. 2020-537244.

* cited by examiner

BACKPACK

CROSS-REFERENCE TO RELATED APPLICATIONS

The present application claims priority to U.S. provisional Ser. No. 62/613,795, filed on Jan. 5, 2018 and entitled, "BACKPACK", which application is incorporated fully herein by reference for any and all non-limiting purposes.

FIELD

The present disclosure relates generally to non-rigid, semi-rigid and rigid portable container devices useful for storing personal belongings in a sealed storage compartment.

BACKGROUND

Containers may be designed to store a user's personal belongings in order to provide a degree of protection from incidental impact (e.g. drops), as well as from liquids and dirt. Containers may be composed of rigid materials such as metal or plastics or flexible materials such as fabric or foams. Containers may be designed with an opening/aperture that allows access to the interior contents of the container. The opening may also be provided with a closure mechanism.

SUMMARY

This Summary provides an introduction to some general concepts relating to this invention in a simplified form that are further described below in the Detailed Description. This Summary is not intended to identify key features or essential features of the invention.

Aspects of the disclosure herein may relate to container devices having one or more of (1) a partial or full waterproof closure (2) a magnetic closure.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

Figure 1:
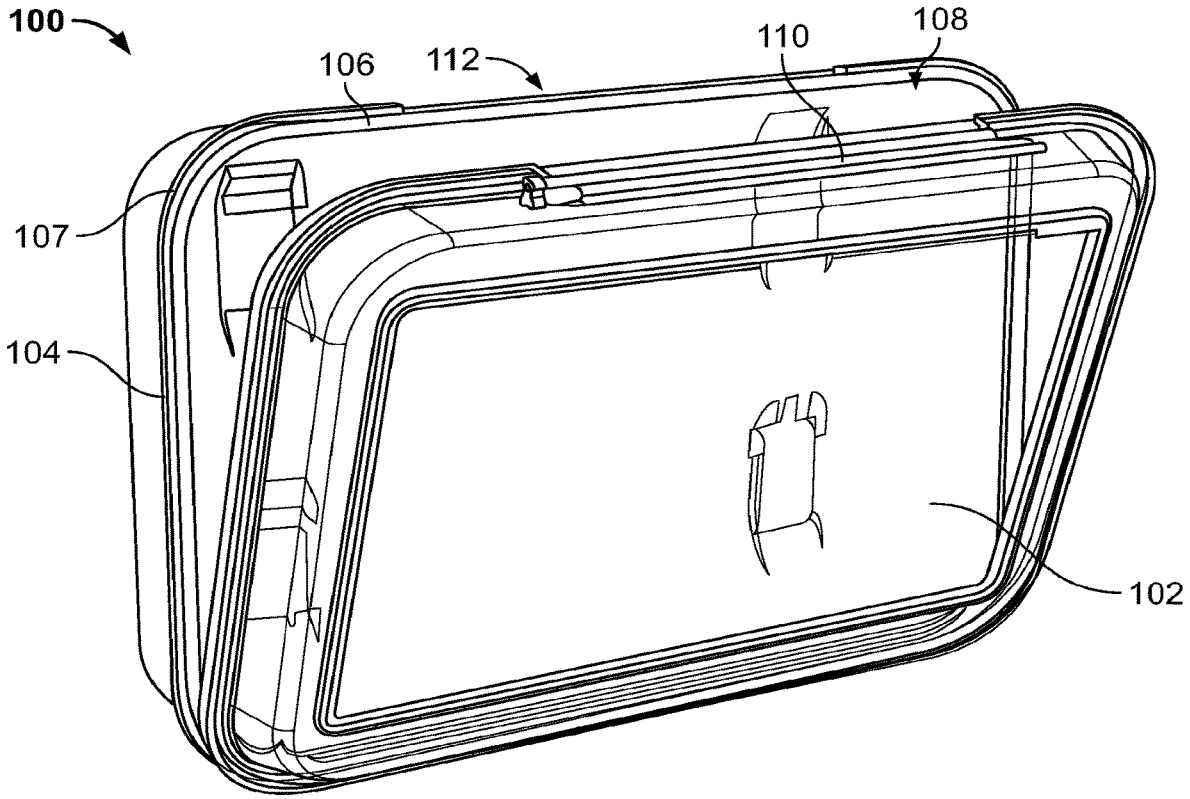
FIG. 1 schematically depicts an implementation of a container, according to one or more aspects described herein.

Further, it is to be understood that the drawings may represent the scale of different components of various examples; however, the disclosed examples are not limited to that particular scale. Further, the drawings should not be interpreted as requiring a certain scale unless otherwise stated.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "frontside," "backside," "front," "back," "top," "base," "bottom," "side," "forward," and "rearward" and the like may be used in this specification to describe various example features and elements, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the claims.

In the description that follows, reference is made to one or more container structures. It is contemplated that any of the disclosed structures may be constructed from any polymer, composite, and/or metal/alloy material, without from the scope of these disclosures. Additionally, it is contemplated that any manufacturing methodology may be utilized, without departing from the scope of these disclosures. For example, one or more welding (e.g. ultrasonic welding or laser welding of fabric, or metal/alloy welding), gluing, stitching, molding, injection molding, blow molding, stamping, deep-drawing, casting, die-casting, drilling, deburring, grinding, polishing, sanding, or etching processes, among many others, may be utilized to construct of the various containers described throughout these disclosures. Additionally, where reference is made to a magnetic element or structure throughout these disclosures, it may be assumed that the element or structure includes one or more magnets (e.g. permanent magnets), or one or more metals or alloys (e.g. ferromagnetic materials, among others) that are attracted to magnets.

It is contemplated that any of the containers discussed throughout this document may be partially or fully watertight, airtight, and/or sealed to substantially or fully prevent dust or other materials from entering into and/or escaping from the containers. For example, containers 100, 200, 300, 400, 700, 800, and/or 1400, which are described in further detail in the proceeding paragraphs, may include partially or fully water resistant outer shells/outer walls and closure mechanisms.

FIG. 1 schematically depicts an implementation of a container 100, according to one or more aspects described herein. It is contemplated that a container, such as container 100, may alternatively be referred to as a pouch, bag, box, or vessel, among others, through these disclosures. In one example, container 100 may have a hard shell that is resistant to deformation. In one implementation, the container 100 has a clamshell mechanism with a front shell 102 that is hingedly coupled to a back shell 104. Where discussed throughout these disclosures, a hinge coupling may utilize one or more of a flexure element (e.g. a live hinge), or a piano hinge, among many others. It is contemplated that the shells 102 and 104 may be constructed from any polymer, composite, and/or metal/alloy material, among others. In one implementation, the front shell 102 may be partially or wholly transparent. In one example, the front shell 102 and/or the back shell 104 may be constructed from a polycarbonate material. However, additional or alternative polymeric materials may be utilized, without departing from the scope of these disclosures.

The container 100 may have a gasket 106 that extends around at least a portion of an internal perimeter of the back shell 104. The gasket 106 may be positioned within a channel 107 of the back shell 104. The gasket 106 may be constructed from silicone, neoprene, nitrile, polyvinylchloride, or butyl rubber, among others. In one example, the gasket 106 may be configured to partially or wholly seal the opening 108 into an internal storage compartment within the container 100.

In one implementation, it is contemplated that the container 100 may include a closure mechanism, which may otherwise be referred to as a fastener mechanism throughout these disclosures, having a clasp 110 that is hingedly coupled to the front shell 102, and configured to removably couple to a top portion 112 of the back shell 104. In certain examples, the clasp 110 in conjunction with the gasket 106 can create a waterproof or water resistant seal between the front shell 102 and back shell 104. Moreover, the container 100 can be formed of a waterproof or water resistant fabric to form a dry compartment within the container 100. However, additional or alternative closure mechanisms may be utilized, without departing from the scope of these disclosures. For example, the container 100 may utilize two or more clasps similar to clasp 110, one or more zippers, rail-type closure mechanisms, hook and loop fasteners, tabs, interference fitting closure mechanisms, or magnetic closure mechanisms, without departing from the scope these disclosures.

Figure 2:
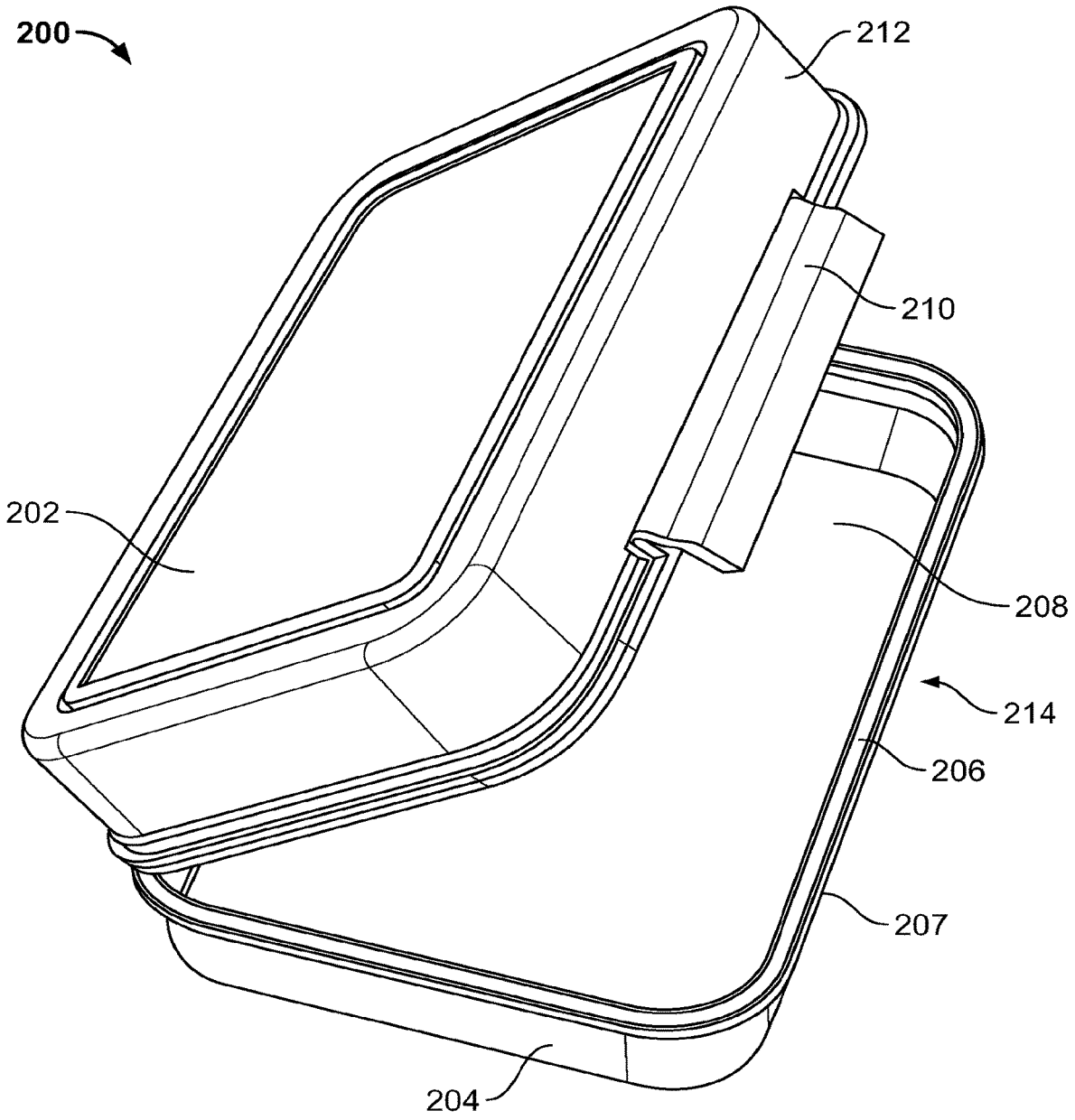
FIG. 2 schematically depicts an implementation of a container, according to one or more aspects described herein.

FIG. 2 schematically depicts an implementation of a container 200, according to one or more aspects described herein. The container 200 may have a firm shell that is at least partially resistant to deformation. In one specific example, container 200 utilizes a clamshell design and has a front shell 202 that is hingedly coupled to a back shell 204. The back shell 204 may have a gasket 206 that is positioned within a channel 207 extending around at least a portion of an internal perimeter of the back shell 204. As depicted, an opening provides access to an internal storage compartment 208 of the container 200. This internal storage compartment 208 may be partially or wholly sealed (e.g. partially or wholly sealed to air and/or water, among others), when the front shell 202 is engaged with the back shell 204 along the gasket 206. In one example, the gasket 206 may be similar to the gasket 106 described in relation FIG. 1. It is further contemplated that the container 200 may be constructed from a molded Ethylene Vinyl Acetate material that has a fabric coating.

In the depicted example, the container 200 may include a closure mechanism that has a clasp 210 that is hingedly coupled to a top surface 212 of the front shell 202. Accordingly, the clasp 210 may be configured to engage with a tab structure (not depicted) on a top surface 214 of the back shell 204. Like in the above example, it is also contemplated that the clasp 110 in conjunction with the gasket 206 can create a waterproof or water resistant seal between the front shell 202 and back shell 204. Moreover, the container 200 can be formed of a waterproof or water resistant fabric to form a dry compartment within the container 200. However, additionally or alternative closure mechanisms may be utilized, such as a magnetic closure mechanism, or hook and loop fasteners, among others.

Figure 3A:
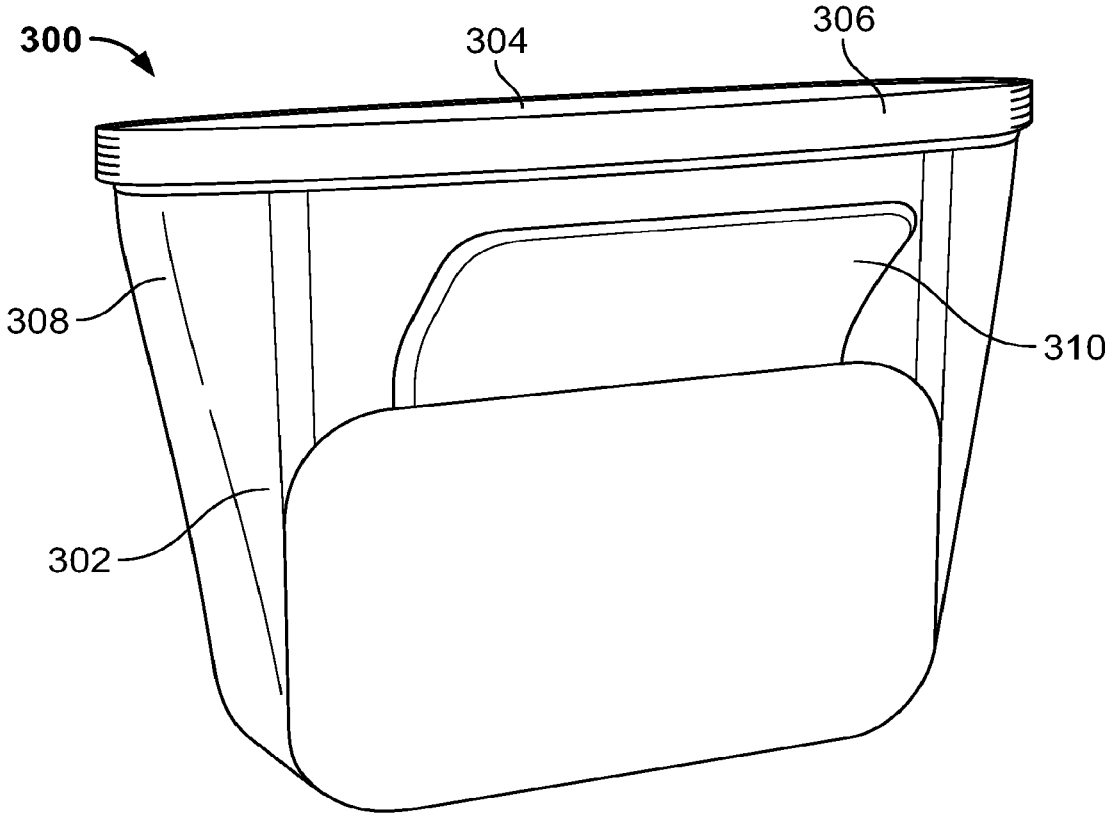
FIGS. 3A and 3B schematically depict another implementation of a container, according to more aspects described herein.
Figure 3B:
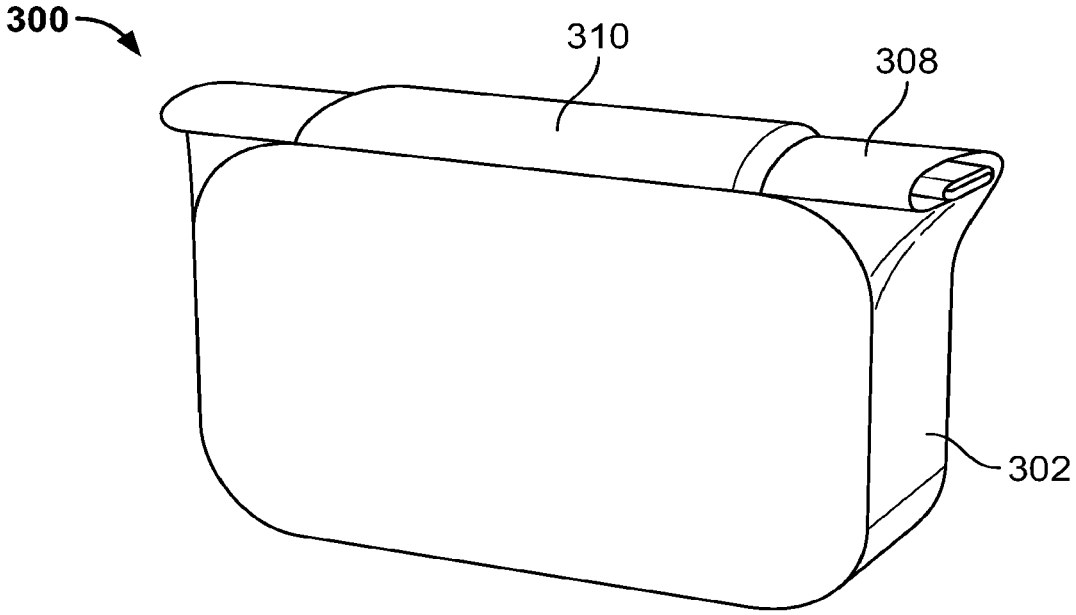

FIGS. 3A and 3B schematically depict another implementation of a container 300, according to more aspects described herein. In particular, FIG. 3A schematically depicts container 300 in an open configuration and FIG. 3B schematically depicts container 300 in a closed configuration. In one implementation, container 300 is constructed from one or more deformable materials, such that one or more surfaces of the outer shell 302 may be folded.

In one example, an opening 304 extends into an internal storage compartment of the container 300. The opening 304 may be partially or wholly sealed by a first closure mechanism 306. In one example, the first closure mechanism includes a magnetic closure extending around at least a portion of a perimeter of the opening 304. Additionally or alternatively, the first closure mechanism 306 may include a rail-type fastener, and/or a zipper fastener, among others. Further, the opening 304 may be partially or wholly sealed by folding/rolling an upper portion 308 of the outer shell 302 toward at second closure mechanism 310. As depicted in FIG. 3B, the second closure mechanism 310 may be configured to extend over the folded top portion 308 and affix to a back side (not depicted) of the outer shell 302. Accordingly, the second closure mechanism 310 may include one or more hook and loop fasteners, clasp fasteners, ties, or magnetic elements, among others.

Figure 4:
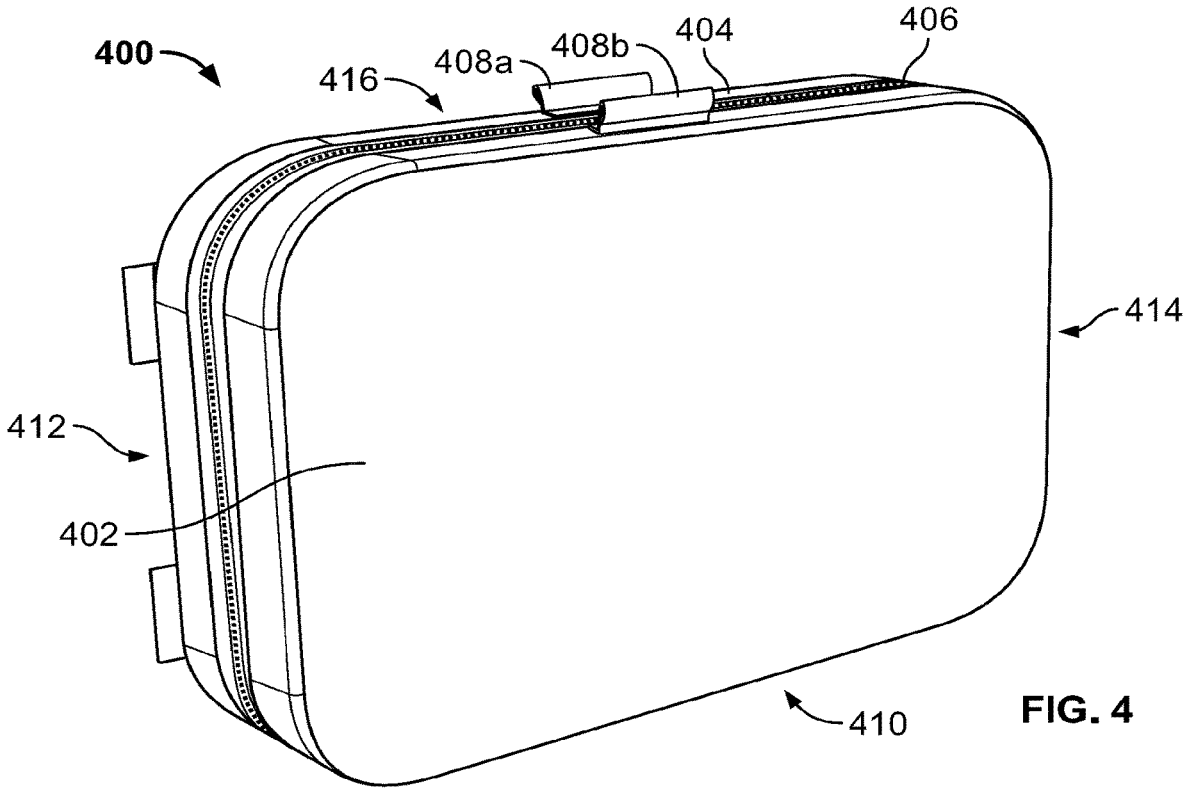
FIG. 4 schematically depicts one implementation of a container, according to one or more aspects described herein.

FIG. 4 schematically depicts one implementation of a container 400, according to one or more aspects described herein. In one implementation, the container 400 has a front shell 402 that is coupled to a back shell 404. In one example, the front shell 402 is coupled to the back shell 404 by a hinge mechanism (not depicted in FIG. 4) positioned along one or more side surfaces of the container 400 (e.g. bottom surface 410, left side surface 412, right side surface 414, and/or top surface 416). The front shell 402 may be coupled to the back shell 404 by one or more additional or alternative closure mechanisms configured to partially or wholly seal an opening that extends into a storage compartment (not depicted in FIG. 4) of the container 400. In one example, the container 400 may include a rail-type closure mechanism, a zipper closure, and/or a magnetic closure mechanism, among others. As such, the one or more additional or alternative closure mechanisms may be configured to seal an opening that extends, partially or wholly, around a frame element 406.

In one example, the container 400 includes pull-tabs 408*a* and 408*b* that are configured to provide grip surfaces onto which at user may manually grasp the container 400 in order to hingedly uncouple/hingedly couple the front shell 402 from/to the back shell 404 to gain access to/seal one or more internal storage compartments of the container 400. It is further contemplated that the container 400 may include one or more alternative coupling mechanisms in place of the hinge mechanism (not depicted in FIG. 4) positioned along one or more side surfaces of the container 400. For example, the front shell 402 may be configured to be removably coupled to the back shell 404.

One or more of the front shell 402 and the back shell 404 may be deformable, or may be partially or fully rigid. In one example, one or more of the front shell 402 in the back shell 404 may be constructed from a molded EVA (Ethylene Vinyl Acetate), and may have a fabric coating. This fabric coating may include any synthetic or natural fiber material, without apparent from the scope of these disclosures. It is further contemplated that the container 400 may utilize any polymer, composite, and/or metal/alloy without departing from the scope of these disclosures.

Figure 5:
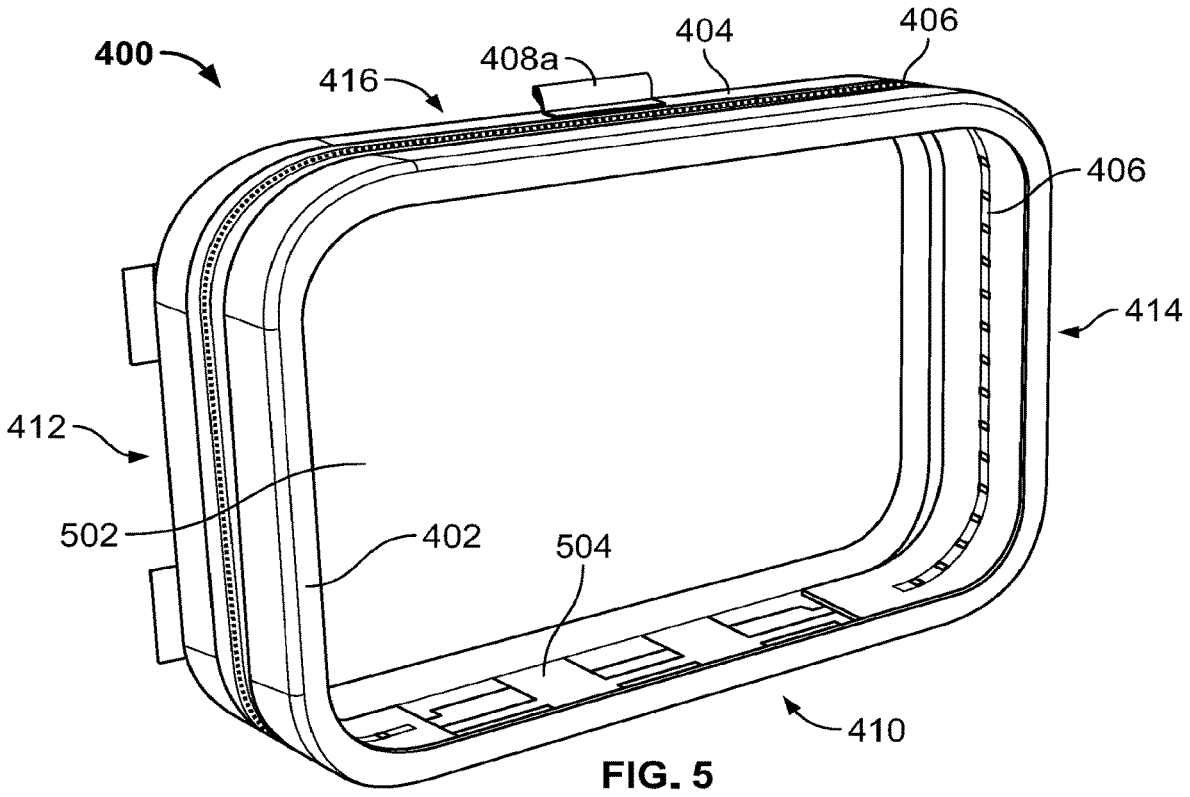
FIG. 5 schematically depicts another view of the container from FIG. 4, according to one or more aspects described herein.

FIG. 5 schematically depicts another view of the container 400 that has a front surface of the front shell 402 removed in order to provide a view into an internal compartment 502 of the container 400. FIG. 5 schematically depicts a hinge mechanism 504 that extends along a portion of the bottom surface 410, and is configured to hingedly couple the front shell 402 to the back shell 404. Additionally, FIG. 5 schematically depicts an internal view of the frame 406 that extends at least partially around a perimeter of the container 400. In one example, the frame 406 is constructed from an elastomer. As previously described, the frame 406 includes one or more additional or alternative closure mechanisms configured to partially or wholly seal an opening into the internal storage compartment 502. These additional or alternative closure mechanisms are described in further detail in relation to the proceeding figures.

Figure 6:
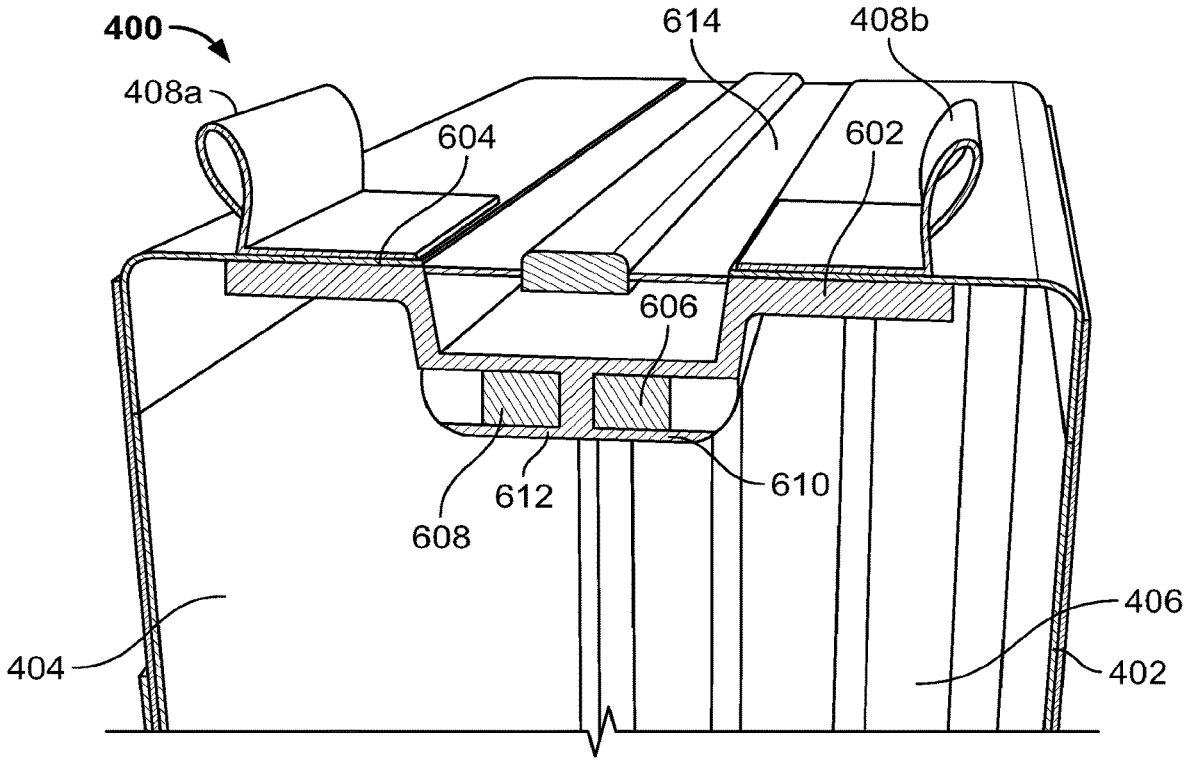
FIG. 6 schematically depicts a cross-sectional view of atop portion of the container from FIG. 4, according to one or more aspects described herein.

FIG. 6 schematically depicts a cross-sectional view of atop portion of the container 400, according to one or more aspects described herein. FIG. 6 schematically depicts the front shell 402 having a front frame 602 that extends around at least a portion of an internal perimeter of the front shell 402. The container 400 also includes a back shell 404 and a back frame 604 that extends around an internal perimeter of the back shell 404. In one example, the container 400 has a closure mechanism that includes a front magnetic strip 606. The front magnetic strip 606 may extend around at least a portion of the front frame 602. Further, the front magnetic strip 606 may be encapsulated within a front channel 610 of the front frame 602. Similarly, the closure mechanism may include a back magnetic strip 608 that extends around at least a portion of the back frame 604. The back magnetic strip 608 may also be encapsulated within a back channel 612 of the back frame 604. It is contemplated that the front magnetic strip 606 and the back magnetic strip 608 may include one or more magnetic elements configured in one or more linear strips, or two-dimensional arrays. For example, the front magnetic strip 606 and the back magnetic strip 608 may include a continuous magnetic element, or several magnetic elements spaced apart from one another within the front channel 610 and the back channel 612. It is contemplated that the front magnetic strip 606 and the back magnetic strip 608 may include one or more permanent magnets, and/or or elements that include metals/alloys that are attracted to magnets. Accordingly, the front magnetic strip 606 may be configured to magnetically couple to the back magnetic strip 608.

Additionally, the closure mechanism of the container 400 may include a zipper 614. The zipper 614 may extend around at least a portion of the front frame 602 and the back frame 604. It is contemplated that any zipper mechanism having any size (e.g. teeth size, spacing) and/or having any slider body and pull type, may be utilized, without departing from the scope of the disclosures. It is further contemplated that the zipper 614 may be configured to be partially or wholly water resistant. As such, the zipper 614, when closed, may partially or wholly prevent water ingress into the storage compartment 502. Additionally or alternatively, the magnetic closure that includes the front magnetic strip 606 and the back magnetic strip 608 may seal the opening into the internal storage compartment 502 such that it is partially or wholly water resistant and/or air tight.

In one example, the zipper assembly 614 can be watertight up to 7 psi above atmospheric pressure during testing with compressed air. However, in other examples, the water tightness of the closure 614 can be from 5 psi to 9 psi above atmospheric pressure and in other examples, the water tightness of the closure 614 can be from 2 psi to 14 psi above atmospheric pressure. The waterproof zipper assembly 614 can include a slider body and pull-tab (not depicted). In one particular example, the waterproof zipper assembly 614 can be constructed with plastic or other non-metallic teeth to prevent injury when retrieving contents from an internal storage compartment of the container 400.

Further advantageously, the magnetic closure mechanism that includes the front magnetic strip 606 and the back magnetic strip 608 may, when the strips 606 and 608 are magnetically coupled to one another, align the front shell 402 with the back shell 404. This magnetic alignment may allow the zipper 614 to be manually opened or closed without any snagging/other partial failure of the zipper mechanism that may be experienced due to misalignment of zipper teeth etc.

Figure 7:
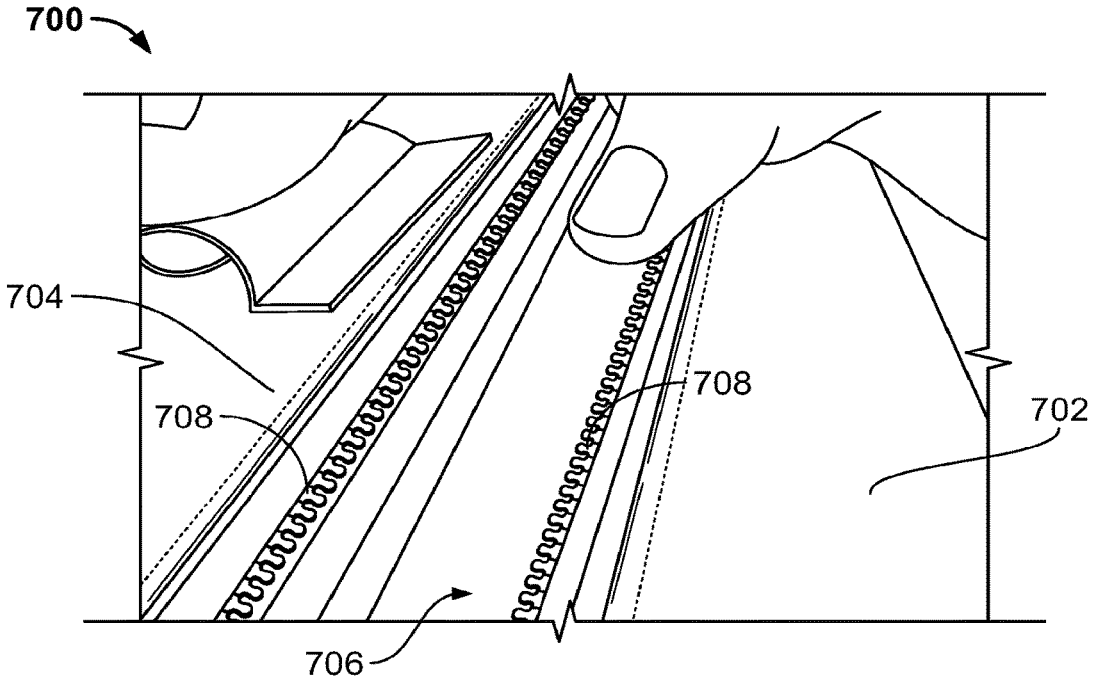
FIG. 7 depicts one implementation of a container, according to one or more aspects described herein.

FIG. 7 depicts one implementation of a container 700 that may be similar to container 400, according to one or more aspects described herein. In particular, the container 700 has a front shell 702 that may be similar to the front shell 402, and a back shell 704 that may be similar to the back shell 404, and configured to be hingedly coupled to the front shell 702. As depicted, the front shell 702 is uncoupled from the back shell 704 such that an internal storage compartment is accessible through opening 706. FIG. 7 also depicts a zipper 708 that may be similar to zipper 614.

Figure 8A:
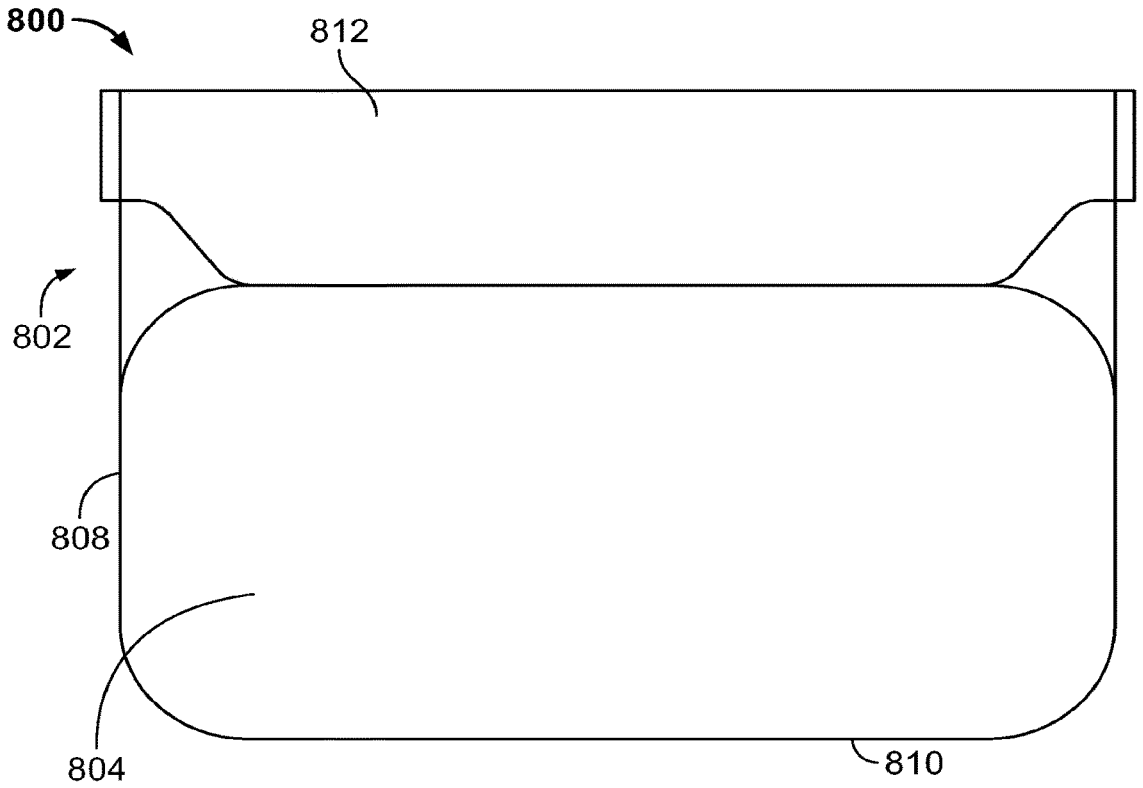
FIGS. 8A-8B schematically depict an implementation of a container, according to one or more aspects described herein.
Figure 8B:
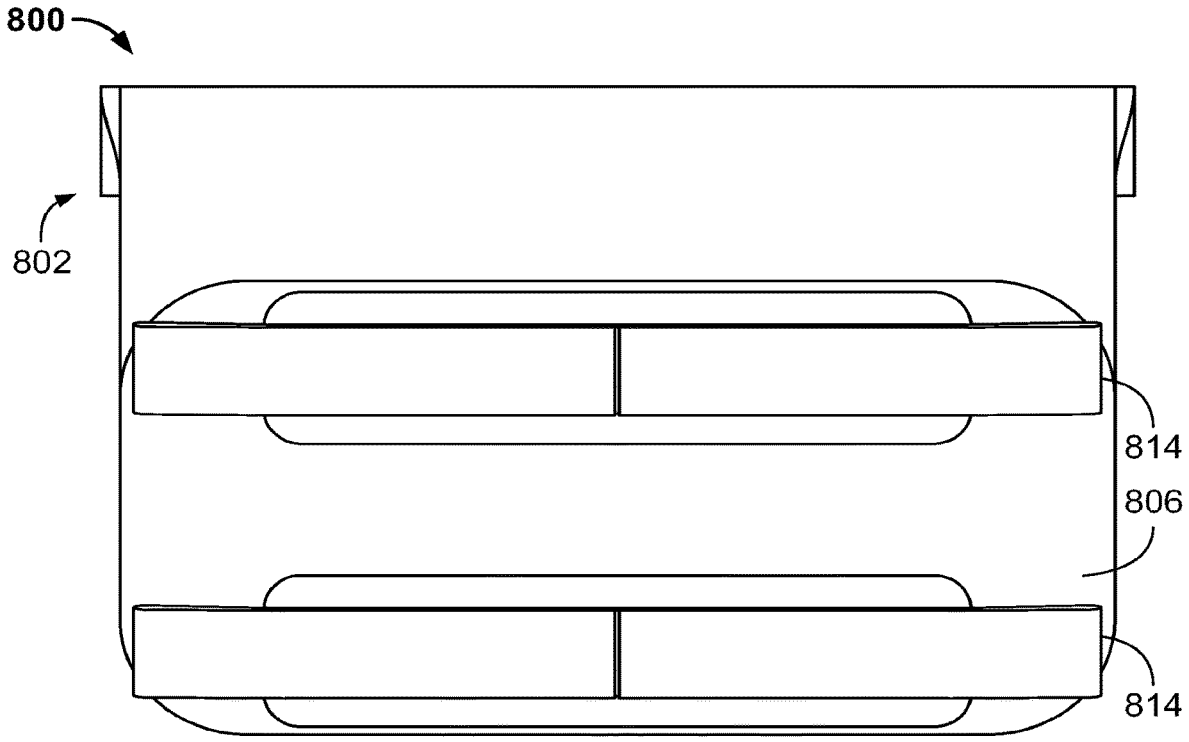

FIGS. 8A-8B schematically depict an implementation of a container 800, according to one or more aspects described herein. In particular, FIG. 8A schematically depicts a front elevation view of the container 800 and FIG. 8B schematically depicts a partial back elevation view of a same implementation of the container 800. In one example, the container 800 may have an outer shell 802 that is formed from a partially or wholly water resistant material. It is contemplated that the outer shell 802 of container 800 may include a front portion 804, a back portion 806, side portions 808, and base portion 810. The container 800 may also include a closure mechanism 812 that may be configured to resealably seal an opening (not depicted in FIG. 8A or 8B) at atop of the container 800. Additionally, the container 800 may include an attachment mechanism 814 on the back portion 806, which may be utilized to removably couple the container 800 to another structure, such as, for example, a bag, an insulating container, or an item of apparel (e.g. a belt), among others. In one implementation, the attachment mechanism may include one or more straps with hook and loop fasteners configured to allow the straps to be removably coupled to an external structure.

In one example, the container 800 may be configured to be removably coupled to another container, such as an insulating device, or insulating container. In particular, the container 800 may be configured to be removably coupled to one or more of the insulating devices described in U.S. patent application Ser. No. 15/261,407 filed 9 Sep. 2016, the entire contents of which are incorporated herein by reference in their entirety for any and all non-limiting purposes. Similarly, any of the other containers 100, 200, 300, 400, 700, and/or 1400 described throughout this document may also be configured to be removably coupled to one or more of the insulating devices described in U.S. patent application Ser. No. 15/261,407.

It is contemplated that the outer shell 802 of the container 800 may be constructed from one or more panels that are coupled to one another to form the depicted front portion 804, a back portion 806, side portions 808, and base portion 810. In particular, the one or more panels may be glued, stitched, or welded (ultrasonic welding, RF welding, among others) together, among others. It is contemplated that the outer shell 802 of the container 800 may have one or more substantially rigid structures, one or more deformable structures, or a combination thereof. Additionally, the outer shell 802 may utilize one or more polymers (such as, among others, polypropylene, polyvinylchloride, polyethylene, polyethylene terephthalate, acrylonitrile butadiene styrene), composite materials, and/or one or more metals/alloys.

Figure 9C:
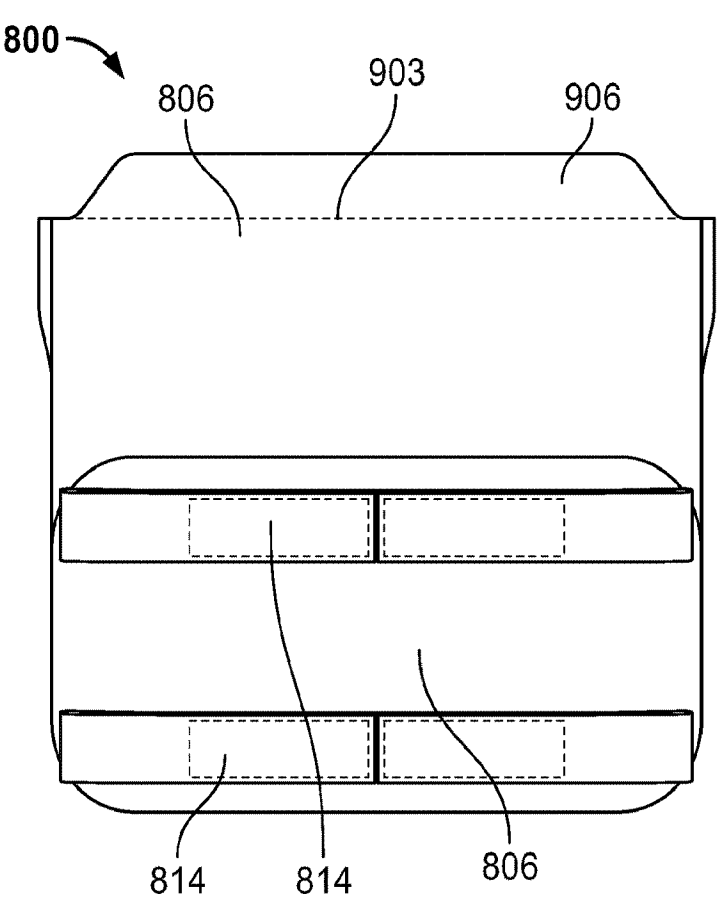
FIGS. 9A-9C schematically depict the container from FIGS. 8A-8B in an open configuration, according to one or more aspects described herein.
Figure 9B:
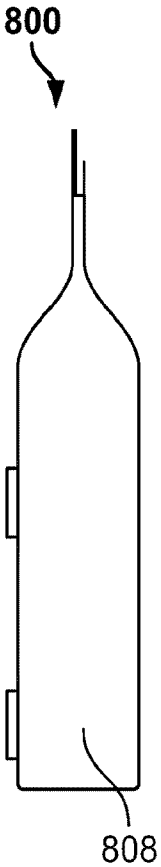
Figure 9A:
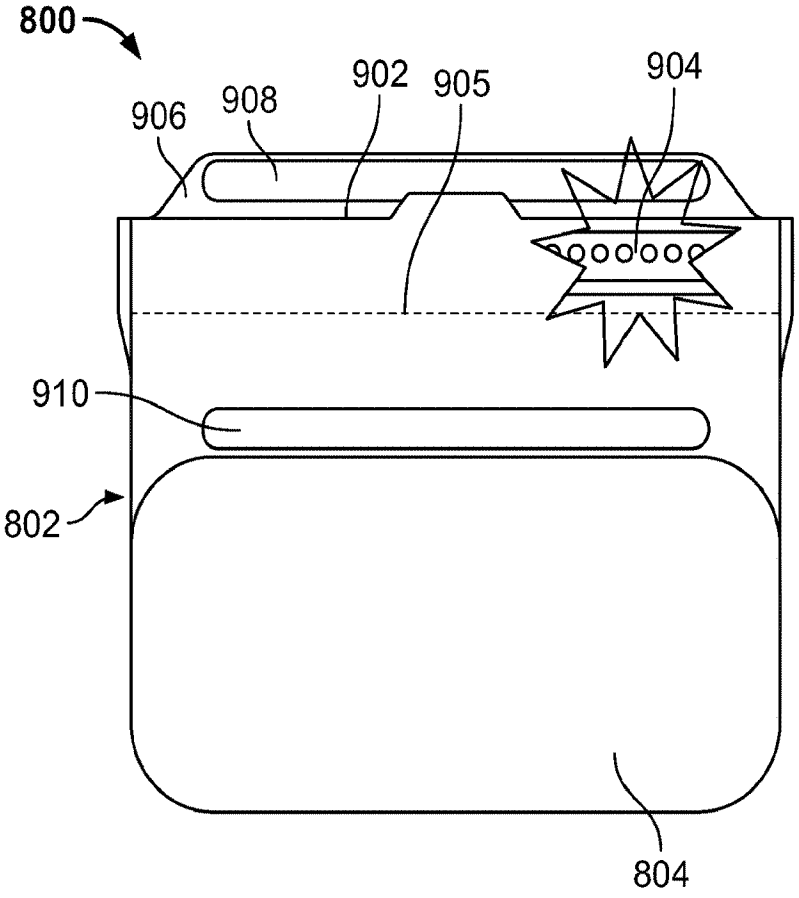

FIGS. 9A-9C schematically depict the container 800 in an open configuration, according to one or more aspects described herein. In particular, FIG. 9A schematically depicts a front elevation view, FIG. 9B schematically depicts a side elevation view, and FIG. 9C schematically depicts a back elevation view of the container 800. In one implementation, an opening 902 may be positioned at a top of the container 800, with the opening extending into one or more storage compartments encapsulated by the outer shell 802. The container 800 may include a closure mechanism that includes a magnetic seal. The magnetic seal is described in further detail in the proceeding sections of this document, and schematically depicted in part within the cutaway window of FIG. 9A as element 904. As will be described in further detail in relation to subsequent figures, the magnetic seal 904 may be configured to magnetically and resealably seal the opening 902 in the container 800. Additionally or alternatively, the closure mechanism of the container 800 may include a flap portion 906 that extends from the back portion 806 above an edge of the opening 902 (edge of opening 902 schematically depicted by dashed line 903). The flap portion 906 may include a first fastener element 908 that is configured to be removably coupled to a second fastener element 910. The second fastener element 910 is further coupled to an external surface of the front portion 804 of container 800. In one example, the first and second fastener elements 908 and 910 may include hook and loop fastener elements. In another implementation, the first and second fastener elements 908 and 910 may include a rail/zipper-type fastener, one or more buttons, clasps, snaps, ties, or interference-type removable couplings, or magnets, among others.

In one implementation, the outer shell of the container 800 may be configured to fold along one or more lines (not depicted in FIGS. 9A-9C) to engage the first and second fastener elements 908 and 910 with one another. It is contemplated that the container 800 may fold along one or more fold lines spaced approximately half way between the first and second fastener elements 908 and 910 (e.g. along the schematically depicted line 905). Additionally or alternatively, at least a portion of the outer shell of the container 800 may be configured to be rolled in order to engage the first and second fastener elements 908 and 910 with one another.

Figure 10:
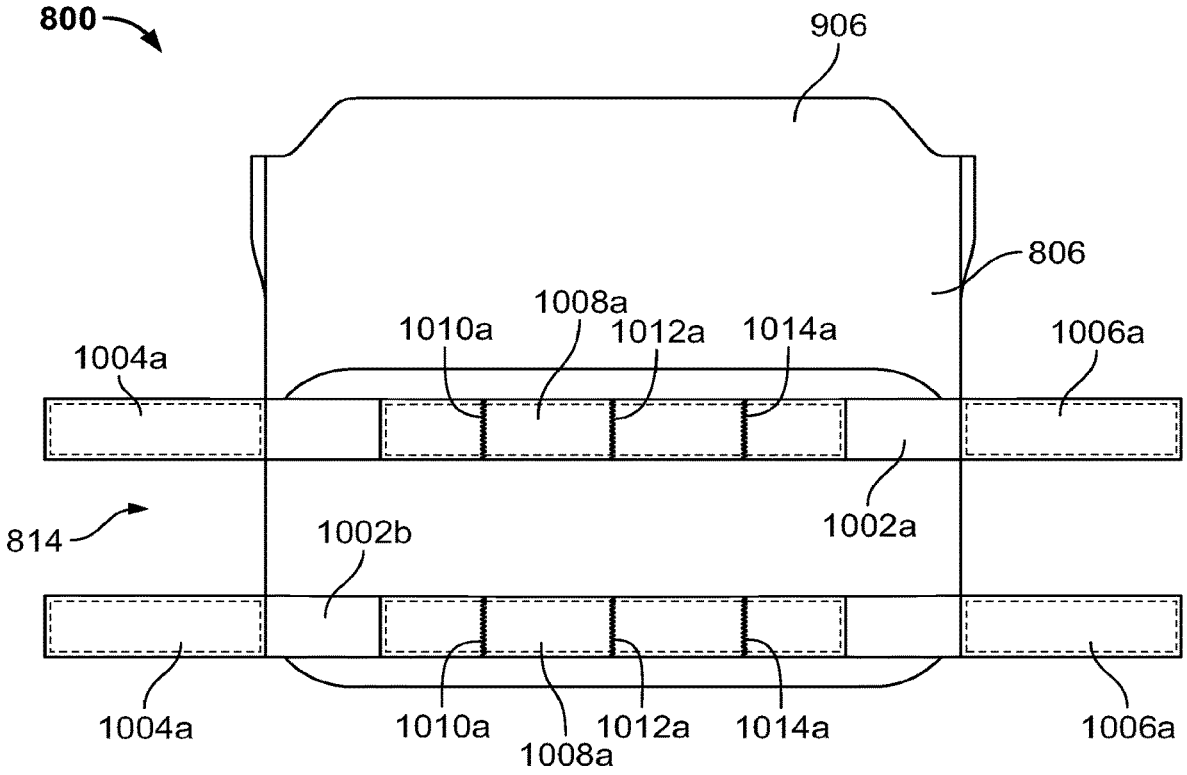
FIG. 10 schematically depicts a view of the back portion of the container from FIGS. 8A-8B, according to one or more aspects described herein.

FIG. 10 schematically depicts a view of the back portion of the container 800, according to one or more aspects described herein. In particular, FIG. 10 schematically depicts the container 800 with the attachment mechanism 814 in an open configuration. In one example, the attachment mechanism 814 may include two straps (e.g. straps 1002*a* and 1002*b*). It is contemplated that the attachment mechanism 814 may utilize a single strap (similar to one of straps 1002*a* and 1002*b*), or three or more straps (similar to one or more of straps 1002*a* and 1002*b*), without departing from the scope of these disclosures. It is contemplated that straps 1002*a* and 1002*b* may be substantially similar. Accordingly, the following describes strap 1002*a* and it may be assumed that similar features are present on strap 1002*b*.

In one implementation, the strap 1002*a* includes fastener elements 1004*a*, 1006*a* and 1008*a*. In one example, elements 1004*a*, 1006*a* and 1008*a* may include hook and loop fasteners, and such that each of elements 1004*a*, 1006*a* and 1008*a* includes one or both of hook and loop elements such that a selected one of the elements 1004*a*, 1006*a* and 1008*a* may be configured to removably couple to itself, or to one or more of the other two fastener elements. In one example, the fastener elements 1004*a*, 1006*a* and 1008*a* may be glued, welded, or sewn onto the strap 1002*a*. For example, elements 1010*a*, 1012*a*, and 1014*a* may represent seams along which the fastener element 1008*a* is sewn to the strap 1004*a*. Further, seams 1010*a*, 1012*a*, and 1014*a* may additionally or alternatively couple the strap 1004*a* to the back portion 806. Further, it is contemplated that fastener elements 1004*a*, 1006*a* and 1008*a* may include fastener structures in addition to, or as an alternative to hook and loop elements. In particular, the fastener elements may include one or more rail/zipper-type fasteners, one or more buttons, clasps, snaps, buckles, pegs, magnets, or ties, among others, without departing from the scope of these disclosures.

Figure 11:
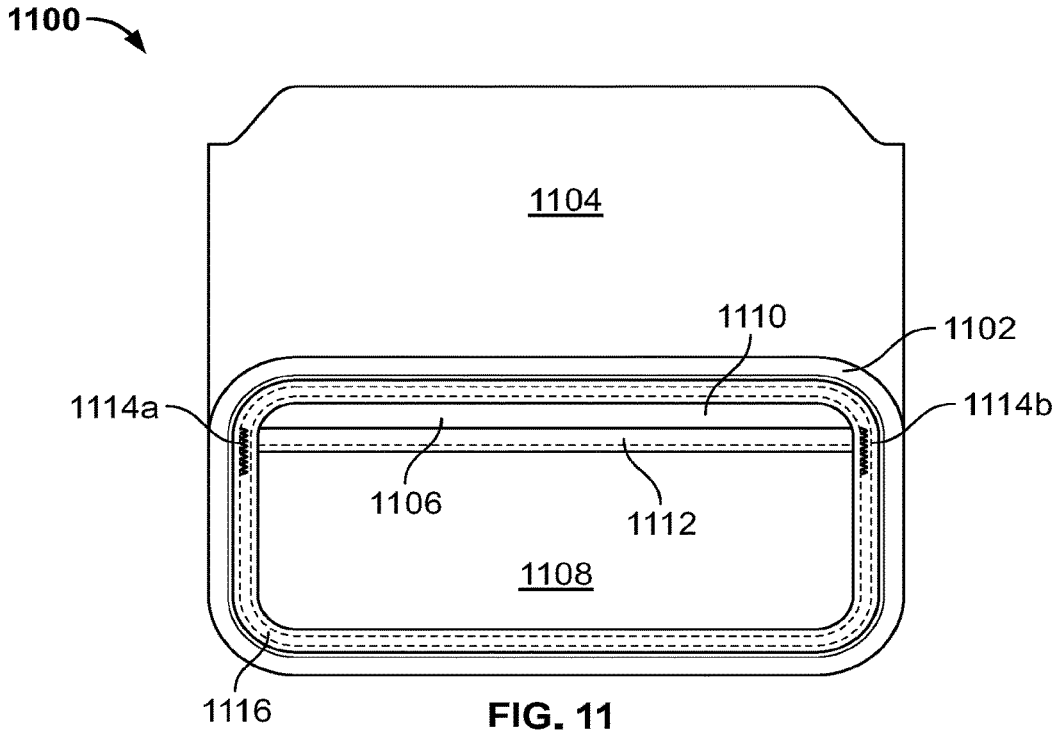
FIG. 11 schematically depicts a portion of an internal back panel of the container from FIGS. 8A-8B, according to one or more aspects described herein.

In one implementation, the storage compartment of the container 800 may include one or more sub-compartments. As such, FIG. 11 schematically depicts a portion of an internal back panel 1100 of the container 800, according to one or more aspects described herein. In particular, the storage compartment of the container 800 may include a storage sub-compartment 1102. In one specific example, the storage sub-compartment 1102 may include a padded slip pocket. In one implementation, the padded slip pocket 1102 may be coupled to an internal back surface 1104. In one example, the back portion 806 of the container 800 may comprise a single layer of material such that the internal back surface 1104 is an internal surface of the back portion 806. In another implementation, the container 800 includes multiple layers of material such that the internal back surface 1104 is a separate structure to that of the back portion 806. It is contemplated that the padded slip pocket 1102 may include an opening 1106 formed between a slip pocket front panel 1108 and a slip pocket back panel 1110. The slip pocket front panel 1108 may have a top edge seam 1112 which is coupled to the slip pocket back panel 1110 at points 1114*a* and 1114*b*. Additionally, the slip pocket back panel 1110 may be coupled to the internal back surface 1104 along seam 1116, which may extend around a full perimeter of the pocket 1108. In one implementation, seam 1116 and coupling points 1114*a* and 1114*b* may comprise sewn couplings. In other implementations, the seam 1116 and coupling points 1114*a* and 1114*b* may additionally or alternatively, be welded or glued, among others.

In certain examples, the sub-compartment 1102 may be padded such that one or more items stored therein is provided an amount of impact absorption to reduce the likelihood of damage if the container 800 is dropped of hit by an external element/structure. Accordingly, one or more of the slip pocket front panel 1108 and the slip pocket back panel 1110 may include one or more padding elements. In one example, one or more of panels 1108 and 1110 may include one or more of a foam (e.g. polyethylene foam), a honeycomb, and/or an air bladder material positioned between two external layers. In another implementation, one or more of panels 1108 and 1110 may include a single layer of a padded material, such as neoprene/polychloroprene, among others.

Figure 12:
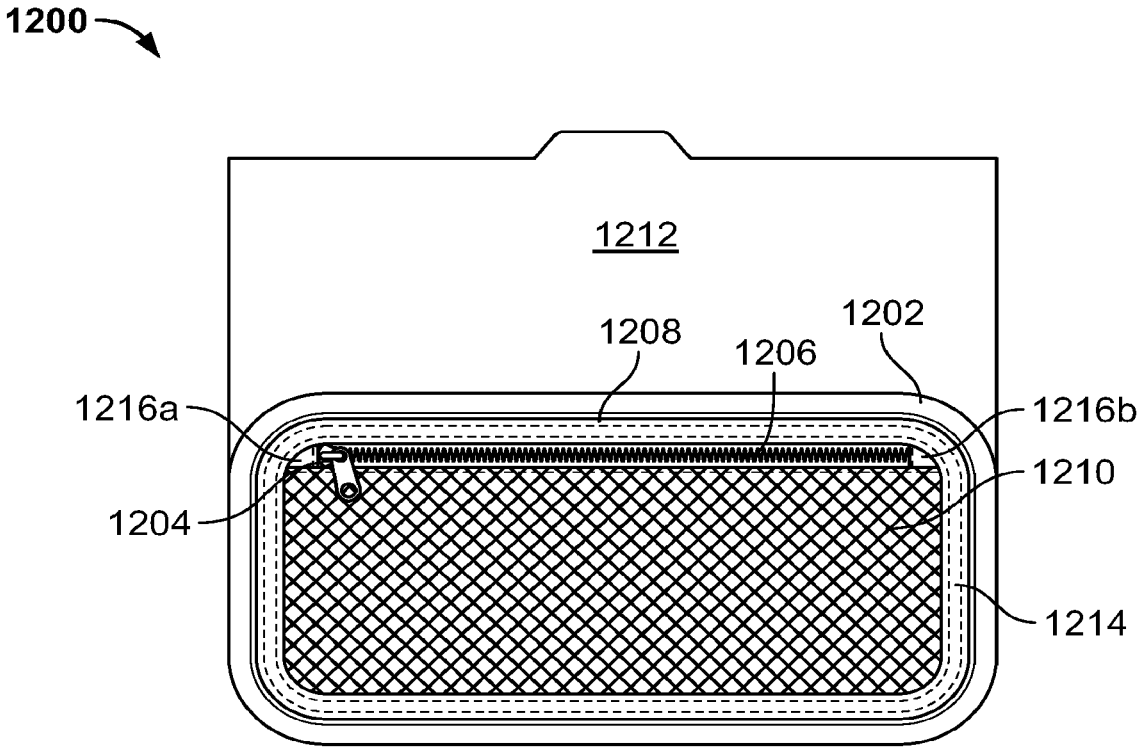
FIG. 12 schematically depicts a portion of an internal front panel of the container from FIGS. 8A-8B, according to one or more aspects described herein.

FIG. 12 schematically depicts a portion of an internal front panel 1200 of the container 800, according to one or more aspects described herein. In a similar manner to sub-compartment 1102 of FIG. 11, FIG. 12 schematically depicts sub-compartment 1202, which may be a padded or unpadded compartment having a zipper closure. In particular, the zipper closure 1204 may be configured to provide a partially or fully sealable closure for opening 1206 that extends into the sub-compartment 1202. Similar to sub-compartment 1102, sub-compartment 1202 may include a zip pocket back panel 1208 and a zip pocket front panel 1210. The zip pocket back panel 1208 may be coupled to the internal front surface 1212 of the container 800. In one example, the internal front surface 1212 is an internal surface of the front portion 804. In other examples, the container 800 may have multiple layers, such that the internal front surface 1212 is spaced apart from the front portion 804 by one or more intermediate material layers.

In one example, the zip pocket back panel 1208 may be coupled to the internal front surface 1212 along seam 1214, which may extend around a full perimeter of the pocket 1202. Further, the seam 1214 may be stitched, welded, or glued, among others. Additionally, the zip pocket front panel 1210 may be coupled to the back panel 1208 and/or internal front surface 1212 along seam 1214. The zipper closure 1204 may include end stops 1216*a* and 1216*b* that are spaced apart across the opening 1206.

One or more of the zip pocket back panel 1208 and zip pocket front panel 1210 may be padded or unpadded, similar to the slip pocket front panel 1108 and a slip pocket back panel 1110. Additionally or alternatively, one or more of the zip pocket back panel 1208 and zip pocket front panel 1210 may include a mesh material or partially or wholly transparent polymer material.

Figures 13A, 13B:
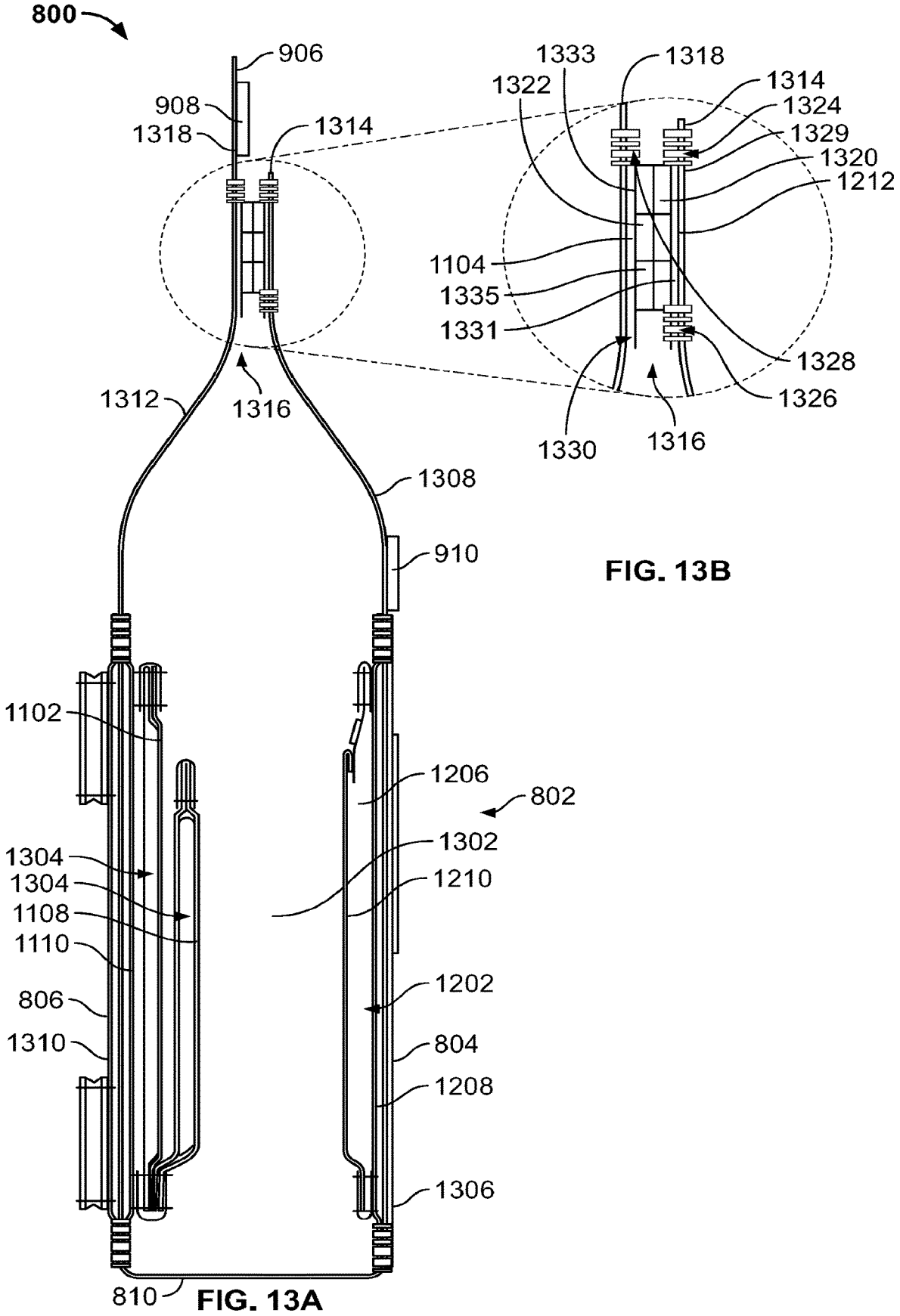
FIG. 13A schematically depicts a cross-sectional end view of one implementation of the container from FIGS. 8A-8B, according to one or more aspects described herein.
FIG. 13B schematically depicts a more detailed view of the opening of the container from FIGS. 8A-8B, according to one or more aspects described herein.

FIG. 13A schematically depicts a cross-sectional end view of one implementation of the container 800, according to one or more aspects described herein. As previously described, an internal compartment 1302 is enclosed by front portion 804, back portion 806, and base portion 810 (as well as side portions 808 not depicted in FIG. 13A). Further, the internal compartment 1302 may include one or more sub-compartments 1102 and 1202.

Further to the description of FIG. 11, FIG. 13A schematically depicts padding layers 1304 within the slip pocket front panel 1108 and slip pocket back panel 1110. In one specific implementation, padding layers 1304 may include 0.5-5 mm of polyethylene foam. It is contemplated that other types of foams, padding materials, and/or other thickness may be utilized, without departing from the scope of these disclosures.

As previously described, one or more of the front portion 804, a back portion 806, side portions 808, and base portion 810 may include multiple material panels that are coupled together. In one specific example, the front portion 804 may include a lower front portion 1306 that is coupled to an upper front portion 1308. Similarly, the back portion 806 may include a lower back portion 1310 that is coupled to an upper back portion 1312. Alternatively, the lower front portion 1306 and the upper front portion 1308 may be formed as a single element, and/or the lower back portion 1310 and the upper back portion 1312 may be formed as a single element.

In one example, the upper front portion 1308 may include a front edge 1314 of the opening 1316 into the compartment 1302. Similarly, the upper back portion 1312 may include a back edge 1318 of the opening 1316.

FIG. 13B schematically depicts a more detailed view of the opening 1316 of container 800, according to one or more aspects described herein. In particular, FIG. 13B schematically depicts a cross-sectional end view of a first magnetic strip 1320 having a first magnetic strip top side 1329 and a first magnetic strip bottom side 1331, and coupled to an internal surface 1212 of the front portion 804 at a front edge 1314 of the opening 1316. Similarly, a second magnetic strip 1322 having a second magnetic strip top side 1333 and a second magnetic strip bottom side 1335, and may be coupled to an internal surface 1104 of the back portion 806 at a back edge 1318 of the opening 1316.

In one implementation, the first magnetic strip 1320 may be rigidly coupled to the internal surface 1212 along at least an upper seam 1324 and a lower seam 1326. Further, the second magnetic strip 1322 may be hingedly coupled to the internal surface 1104. The hinged coupling of the magnetic strip 1322 may be at seam 1328 at the back edge 1318 of the opening 1316. As such, the second magnetic strip 1322 may have a loose end 1330 that is uncoupled from the surface 1104 and may rotate about the seam 1328. Further, the second magnetic strip bottom side 1335 may be unattached to the outer shell 802. In other examples, either or both of the first magnetic strip bottom side 1331 and the second magnetic strip bottom side 1335 may be unattached to the outer shell 802.

Figure 13C:
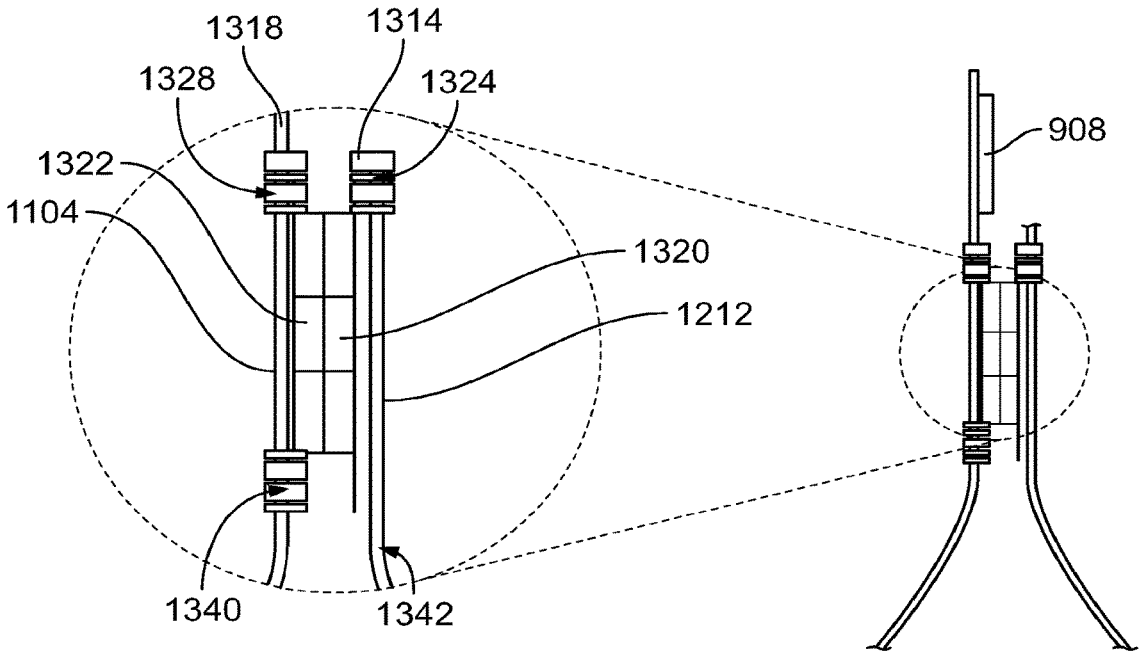
FIG. 13C schematically depicts an alternative implementation of the opening of the container from FIGS. 8A-8B, according to one or more aspects described herein.

In another implementation, as schematically depicted in FIG. 13C, the first magnetic strip 1320 may be hingedly coupled to the internal surface 1212 along the upper seam 1324, and the second magnetic strip 1322 may be rigidly coupled to the internal surface 1104 by the upper seam 1328 and another lower seam 1340, without departing from the scope of these disclosures. As such, the first magnetic strip 1320 may have a loose end 1342 that is uncoupled from the surface 1212 and may rotate about the seam 1324.

Figure 13D:
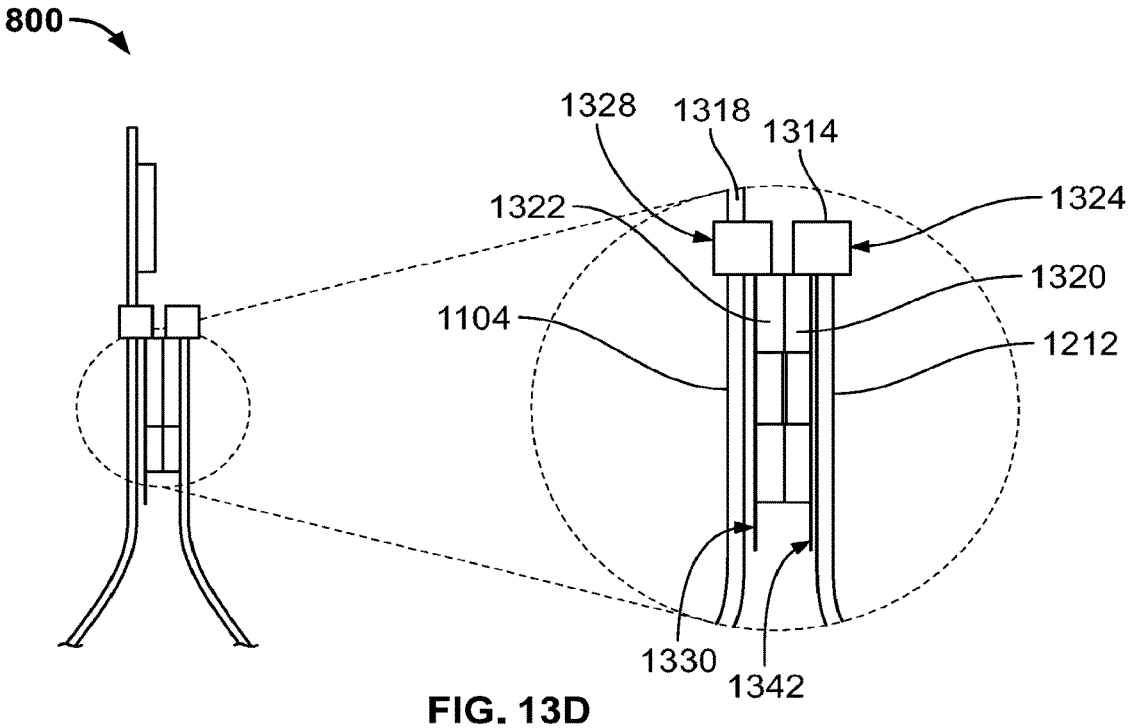
FIG. 13D schematically depicts an alternative implementation of the opening of the container from FIGS. 8A-8B, according to one or more aspects described herein.

In yet another implementation, as schematically depicted in FIG. 13D, both the first magnetic strip 1320 and the second magnetic strip 1322 may be hingedly coupled to the respective internal surfaces 1212 and 1104 at the respective front edges 1314 and 1318. As such, the first magnetic strip 1320 may have a loose end 1342 that is uncoupled from the surface 1212 and the second magnetic strip 1322 may have a loose end 1330 that is uncoupled from the surface 1104.

Advantageously, the hinged coupling of one or more of the first and/or second magnetic strips 1320 and 1322 may allow the magnetic coupling to remain engaged and seal the compartment 1302 up to a comparatively higher internal/external pressure being applied to the sidewalls of the internal compartment 1302 than if both of the magnetic strips 1320 and 1322 were rigidly coupled to the respective internal surfaces 1212 and 1104.

Figure 14:
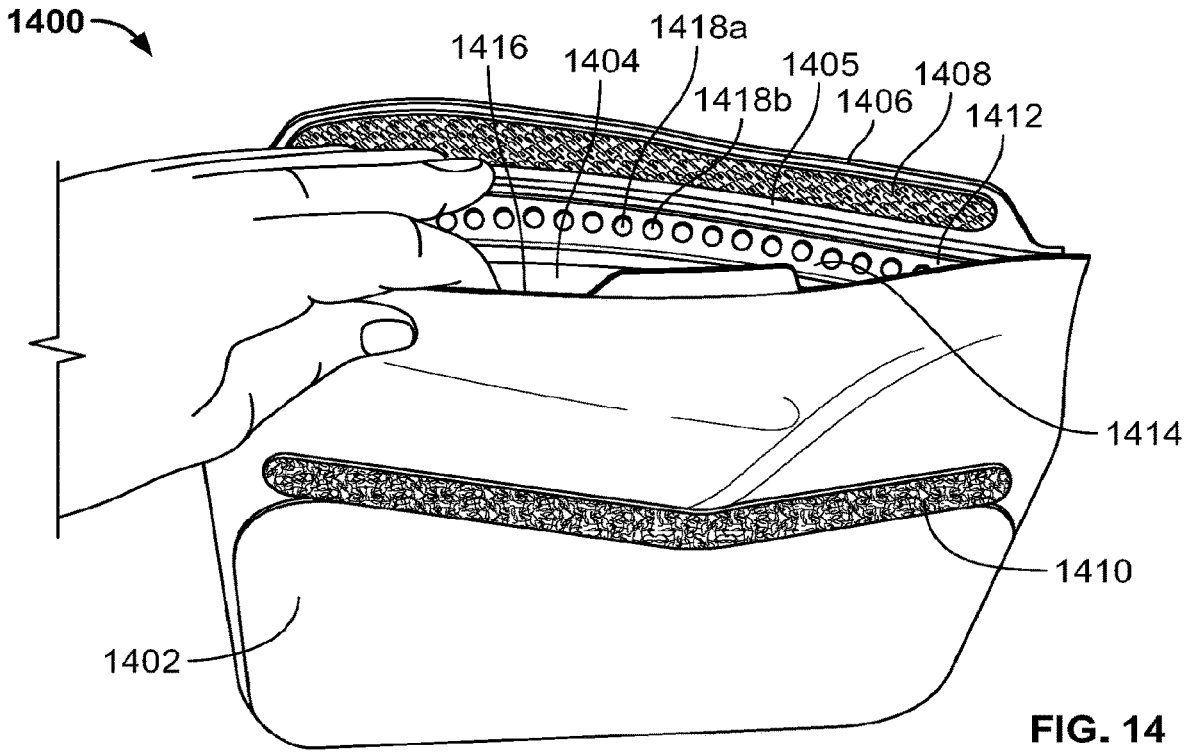
FIG. 14 depicts one implementation of a container, according to one or more aspects described herein.

FIG. 14 depicts one implementation of a container 1400, similar to container 800, according to one or more aspects described herein. In particular, container 1400 may include a front portion 1402 that may be similar to front portion 802, and a back portion 1404 that may be similar to back portion 806. The container 1400 may also include a flap portion 1406 that may be similar to the flap portion 906. As such, the flap portion 1406 may have a first fastener element 1408 coupled thereto. The first fastener element 1408 may be similar to first fastener element 908, and may be configured to couple to a second fastener element 1410 that is coupled to an external surface of the front portion 1402. As such, the second fastener element 1410 may be similar to the second fastener element 910. In one specific example, the first and second fastener elements 1408 and 1410 may include hook and loop fastener elements. However, additional or alternative fastener elements may be utilized with these elements, without departing from the scope of these disclosures.

Additionally, FIG. 14 depicts a magnetic strip 1412. This magnetic strip 1412 may be similar to magnetic strip 1322, and may be configured to magnetically seal an opening 1414 of the container 1400. In particular, the magnetic strip 1412 may be coupled to an internal surface of the back portion 1404 at a back edge 1405 of the opening 1414. In one example, the magnetic strip 1412 may be configured to magnetically attach to a second magnetic strip (not depicted) that is coupled to an internal surface of the front portion 1402 at a front edge 1416 of the opening 1414.

In one implementation, the magnetic strip 1412 may include a row of magnetic elements (e.g. elements 1418*a*, 1418*b* etc.). In one implementation, these magnetic elements 1418*a*, 1418*b* may be permanent magnets. In another example, the magnetic elements 1418*a*, 1418*b* may be magnetically attracted to permanent magnets. It is further contemplated that the magnetic strip 1412 may, additionally or alternatively, include an array of magnetic elements similar to elements 1418*a* and 1418*b* that has two or more rows. Further, it is contemplated that the magnetic strip 1412 may include one or more continuous magnetic bands, rather than a series of multiple magnetic elements (e.g. elements 1418*a* and 1418*b*). These magnetic bands may include one or more magnetic wires or foils, without departing from the scope of these disclosures. Further, additional or alternative implementations of magnetic closures may be utilized with the container 1400, without departing from the scope of these disclosures.

In one example, the magnetic seal formed by the magnetic strips 1320, 1322 and/or 1412 may form a partially or wholly water resistant seal of the openings 902 and/or 1414.

Figure 15:
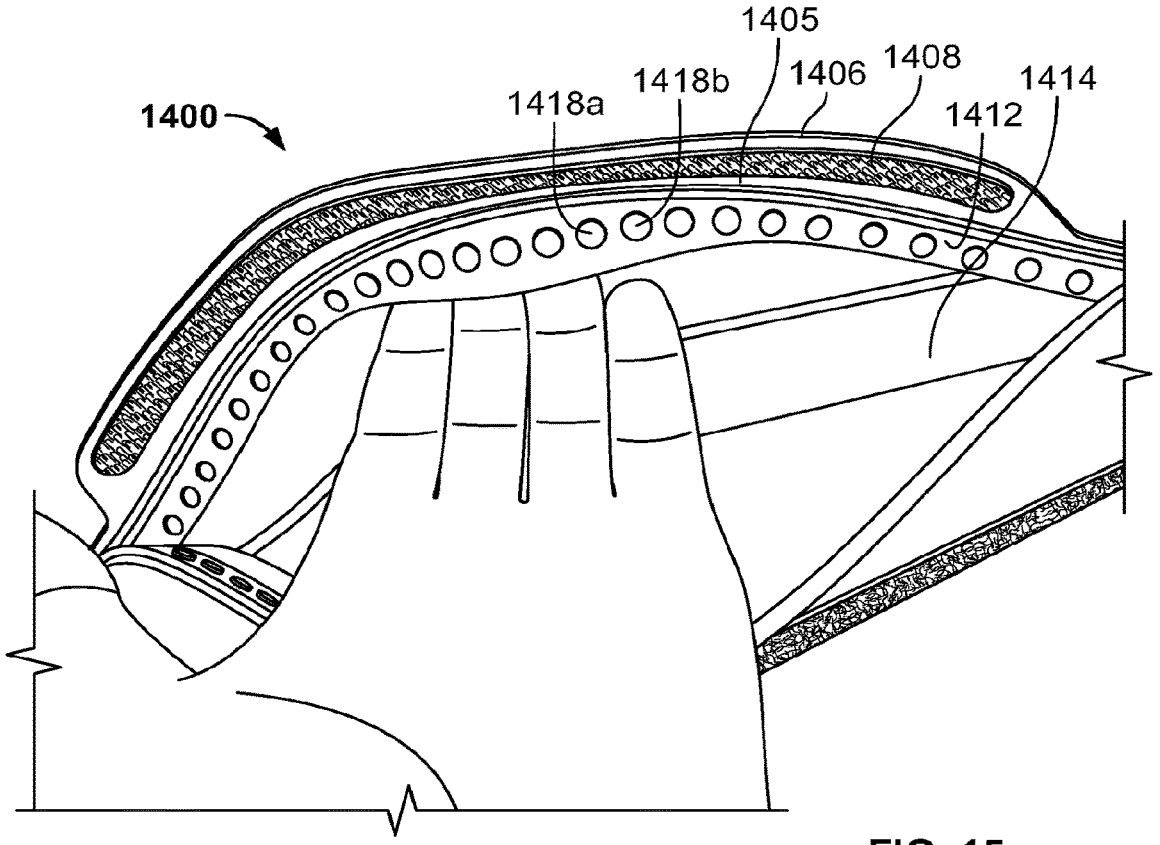
FIG. 15 depicts another view of the container from FIG. 14, according to one or more aspects described herein.

FIG. 15 depicts another view of the container 1400 from FIG. 14, according to one or more aspects described herein. In one example, FIG. 15 illustrates that the magnetic strip 1412 may be hingedly coupled to an internal surface of the back portion 1404 at a back edge 1405 of the opening 1414.

Figure 16:
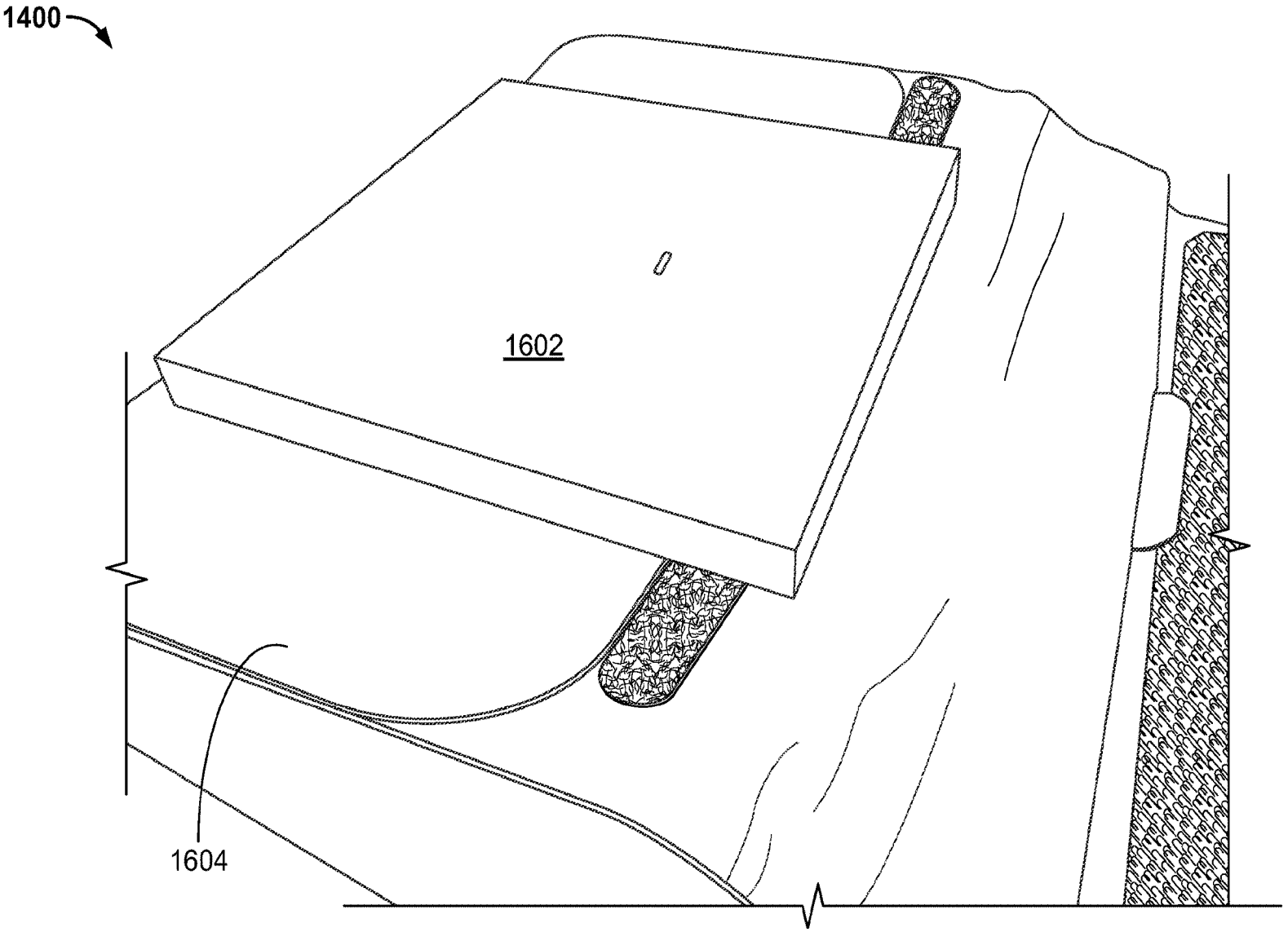
FIG. 16 depicts another view of the container from FIG. 14, according to one or more aspects described herein.

FIG. 16 depicts another view of the container 1400 from FIG. 14, according to one or more aspects described herein. In particular, FIG. 16 depicts a test of the magnetic fastener of the container 1400, e.g. the fastener that includes the magnetic strip 1412 that is configured to magnetically couple to a second magnetic strip in order to seal the opening 1414.

As depicted, the container 1400 demonstrates the ability of the magnetic fastener to maintain an airtight seal as a 5 kg mass is positioned on a back portion 1604 of the container 1600 (in this test setup, the container 1600 only contains air).

Figure 17B:
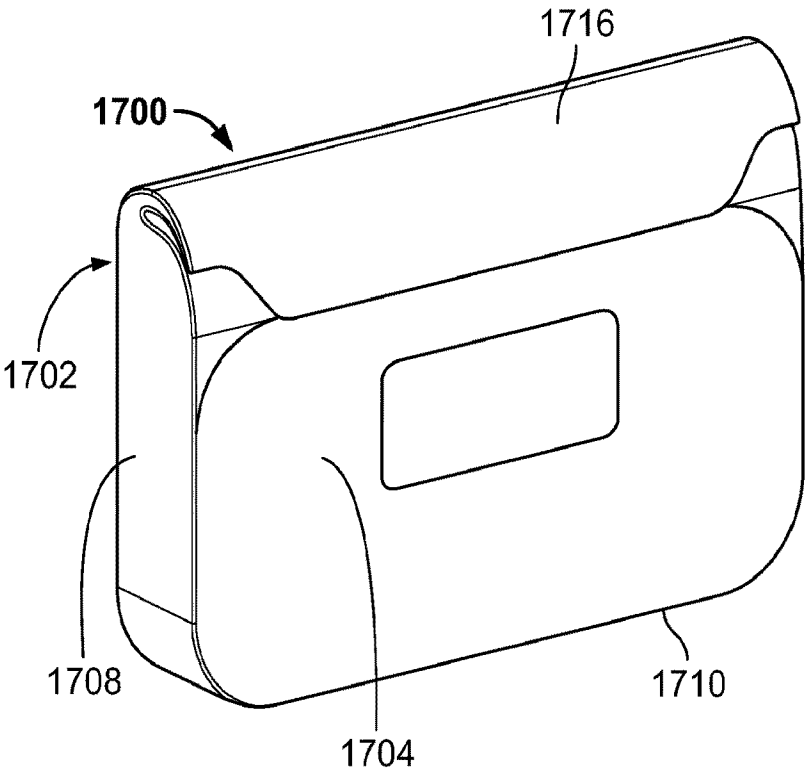
FIGS. 17A-17B schematically depict isometric views of another implementation of a container, according to one or more aspects described herein.
Figure 17A:
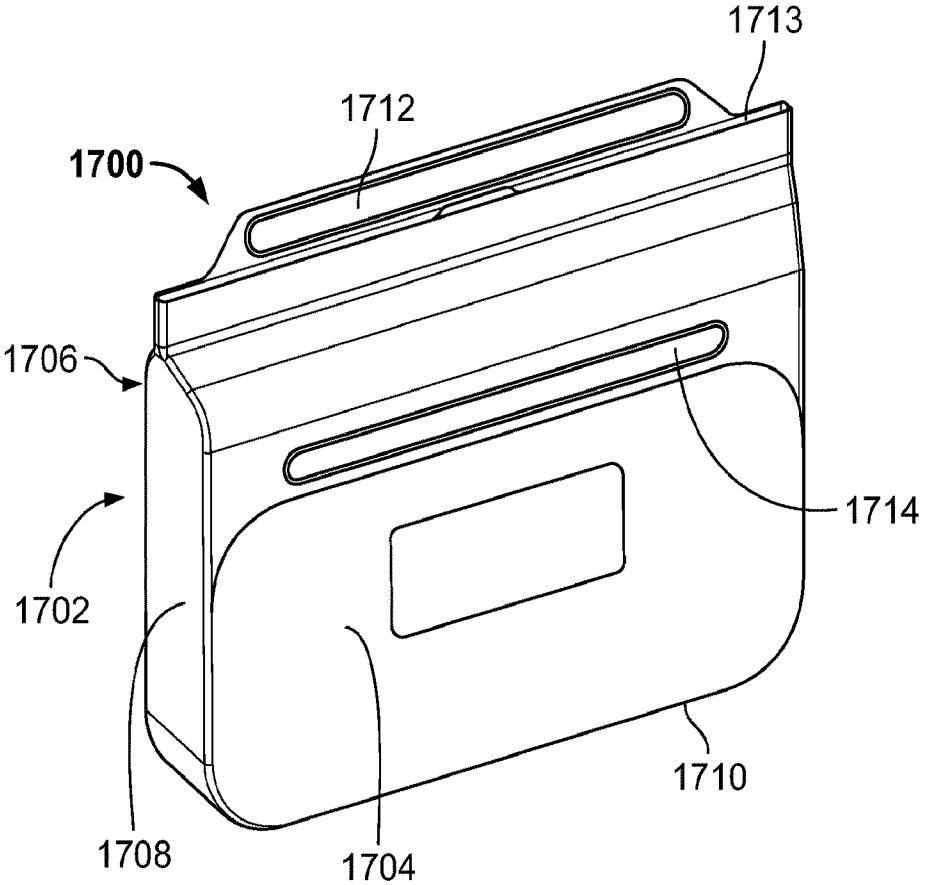

FIGS. 17A-17B schematically depict isometric views of another implementation of a container 1700, according to one or more aspects described herein. In particular, FIG. 17A schematically depicts the container 1700 in an open configuration and FIG. 17B schematically depicts the container in a closed configuration. In one example, container 1700 may be similar to container 800, and have an outer shell 1702 with a front portion 1704, a back portion 1706, side portions 1708, and a base portion 1710. Additionally, container 1700 has a first fastener element 1712 that is configured to be removably coupled to a second fastener element 1714. In order to removably couple the first fastener element 1712 to the second fastener element 1714, a flap portion 1716 of the back portion 1706 may be folded or rolled, to bring the first fastener element 1712 proximate the second fastener element 1714. It is further contemplated that the container 1700 may have a magnetic closure 1713, similar to that of magnetic closure described in relation to FIG. 13B. As such, in one example, when the container 1700 is in the open configuration of FIG. 17A, the magnetic closure may be capable of sealing the container 1700 up to 0.25 psi pressure. In other examples, when the container 1700 is in the open configuration of FIG. 17A, the magnetic closure may be capable of sealing the container 1700 for pressures of up to 0.3 psi, 0.4 psi, 0.5 psi, 0.6 psi, 0.7 psi, or 1.0 psi. Further, when in the closed configuration of FIG. 17B, the combination of the magnetic closure 1713 and the first and second fastener element 1712 and 1714 may be capable of sealing the container 1700 up to a pressure of 2.75 psi. In other examples, the combination of the magnetic closure 1713 and the first and second fastener element 1712 and 1714 may be capable of sealing the container 1700 up to a pressure of 3.0 psi, 3.5 psi, 4.0 psi, 4.5 psi, or 0.50 psi.

Figure 18B:
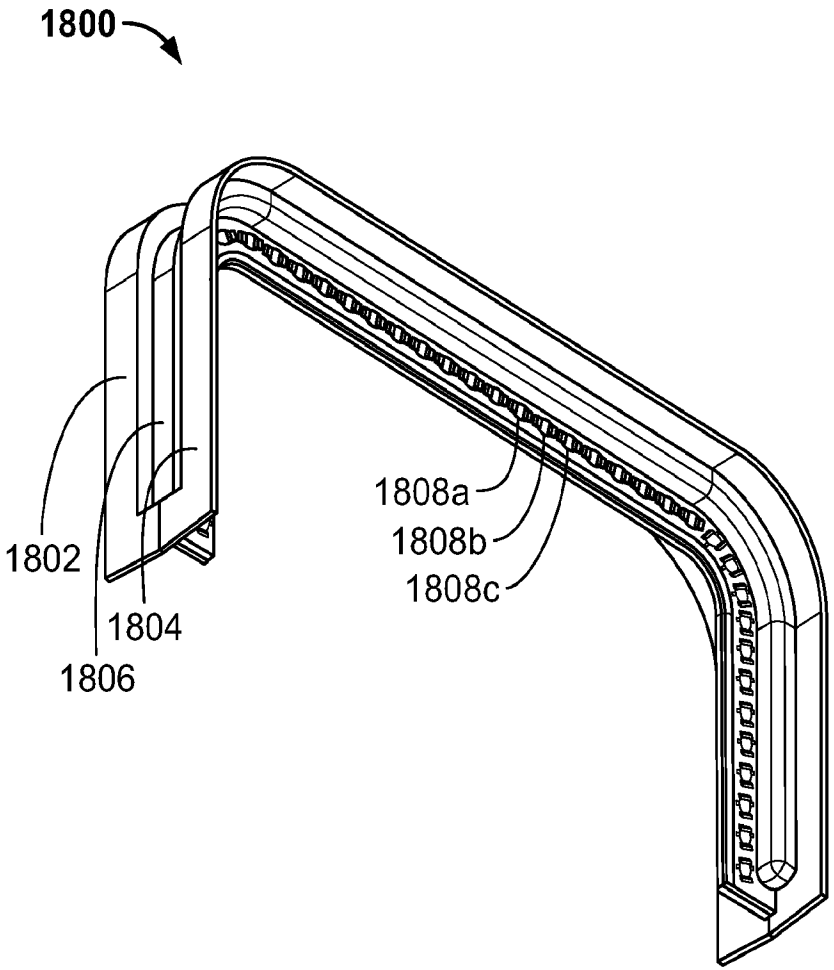
FIGS. 18A-18B schematically depict isometric views of a closure mechanism, according to one or more aspects described herein.
Figure 18A:
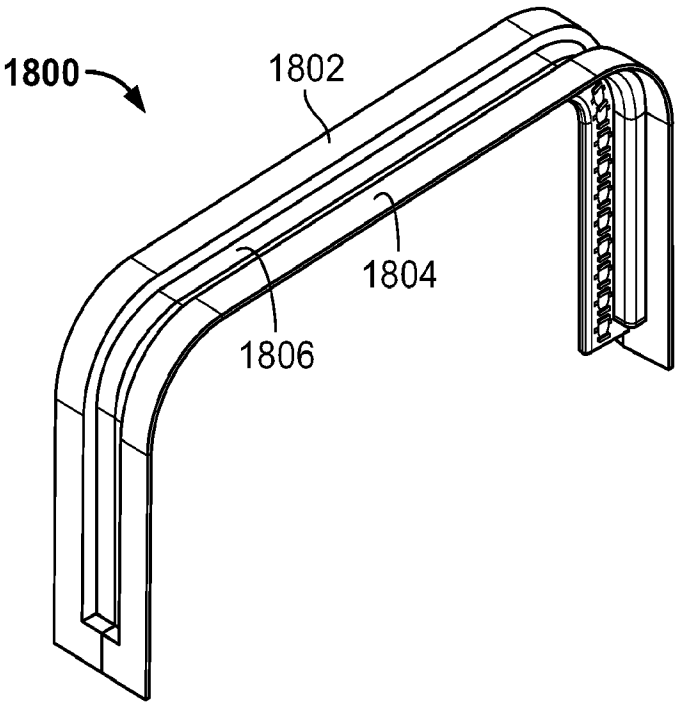

FIGS. 18A-18B schematically depict isometric views of a closure mechanism, according to one or more aspects described herein. In particular, FIG. 18A schematically depicts an isometric view of a top portion of a closure mechanism 1800. The closure mechanism 1800 may be similar to the closure mechanism of container 400, and include a back frame 1802, similar to back frame 604, that is configured to be magnetically and removably coupled to a front frame 1804, similar to front frame 602. When coupled, as depicted in FIGS. 18A-18C, a zipper trough, or zipper channel 1806 is formed. In one example, the zipper trough 1806 may be configured to provide clearance for a slider body to move along a zipper tape (e.g. zipper 614). FIG. 18 B schematically depicts an isometric view of a bottom portion of the closure mechanism 1800. In one example, each of the back frame 1802 and the front frame 1804 may include a plurality of magnetic elements, of which elements 1808*a*-1808*c* are examples of a plurality of similar elements. In one implementation, the magnetic elements, e.g. elements 1808*a*-1808*c*, may be coupled to the front frame 1804 and the back frame 1802 using one or more molding, overmolding, gluing, or interference fitting processes. In one example, the magnetic elements within each of the back frame 1802 and the front frame 1804 may abut one another when the front frame 1804 is magnetically coupled to the back frame 1802. In another example, the magnetic elements within each of the back frame 1802 and/or the front frame 1804 may exert a magnetic force to without directly contacting one another. In one example, the magnetic elements, e.g. elements 1808*a*-1808*c*, may be permanent magnets, or may be ferromagnetic or paramagnetic materials. Additionally or alternatively, the closure mechanism 1800 may include magnetic strips, rather than discrete magnetic elements (e.g. elements 1808*a*-1808*c*), without departing from the scope of these disclosures.

Figure 19:
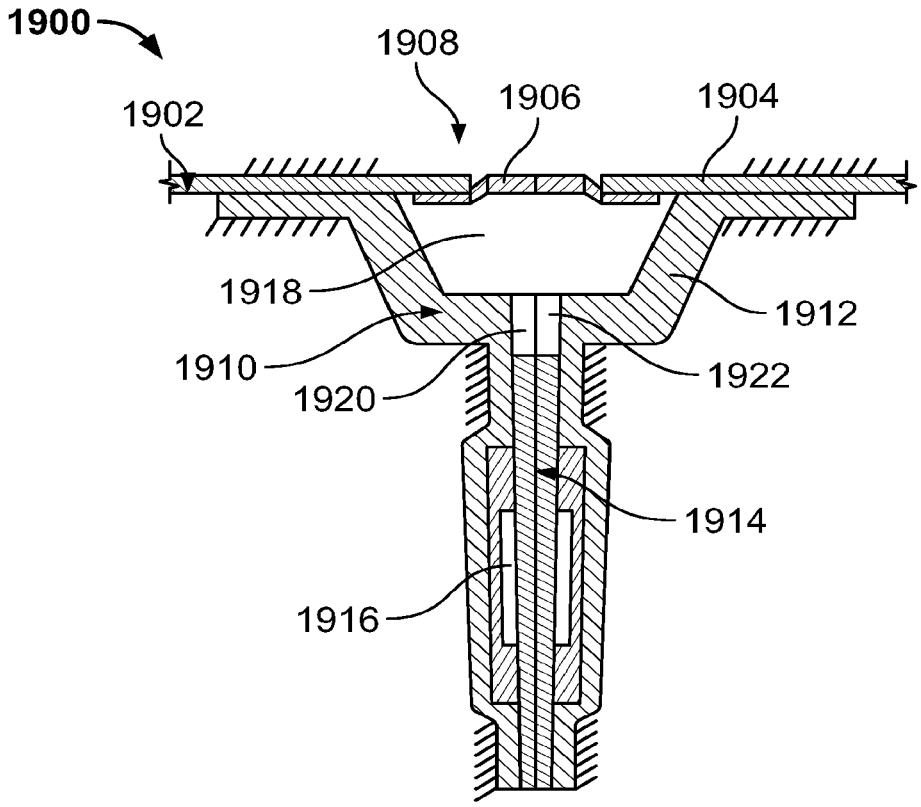
FIG. 19 schematically depicts a cross-sectional view of another implementation of a closure mechanism, according to one or more aspects described herein.

FIG. 19 schematically depicts a cross-sectional view of another implementation of a closure mechanism 1900, according to one or more aspects described herein. In one example, the closure mechanism 1900 may be similar to the closure mechanism of container 400, and include a back shell 1902 and a front shell 1904 which form an outer shell of a container, similar to container 400. Additionally, the closure mechanism 1900 may include a zipper 1906 that is configured to provide a first closure of an opening 1908 between the back shell 1902 and the front shell 1904. In one example, the zipper 1906 may be stretchably coupled to the back shell 1902 and the front shell 1904 such that when the zipper 1906 is closed a tensile force urges a front frame 1912 toward a back frame 1910. In turn, this tensile force urges a front magnet strip 1914 toward a back magnetic strip 1916. In one example, when the front frame 1912 is magnetically and removably coupled to the back frame 1910, a zipper trough 1918 is formed. In another example, the closure mechanism 1900 may include gasket elements 1920 and 1922 configured to provide additional sealing of the opening 1908 when the front magnet strip 1914 is magnetically coupled to the back magnetic strip 1916.

Figure 20:
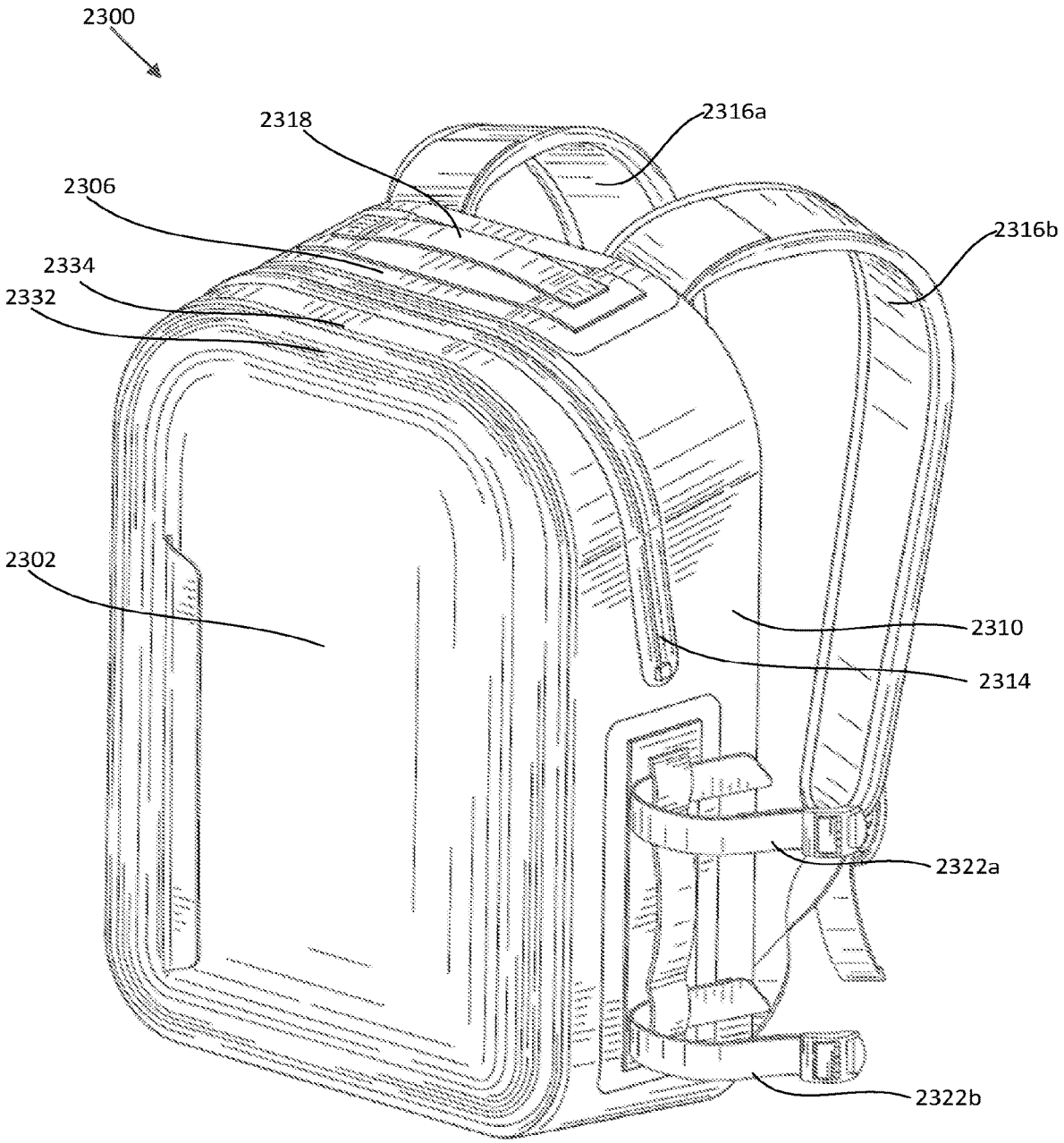
FIGS. 20-24 generally depict a bag that can be configured to store various contents, according to one or more aspects described herein.
Figure 21:
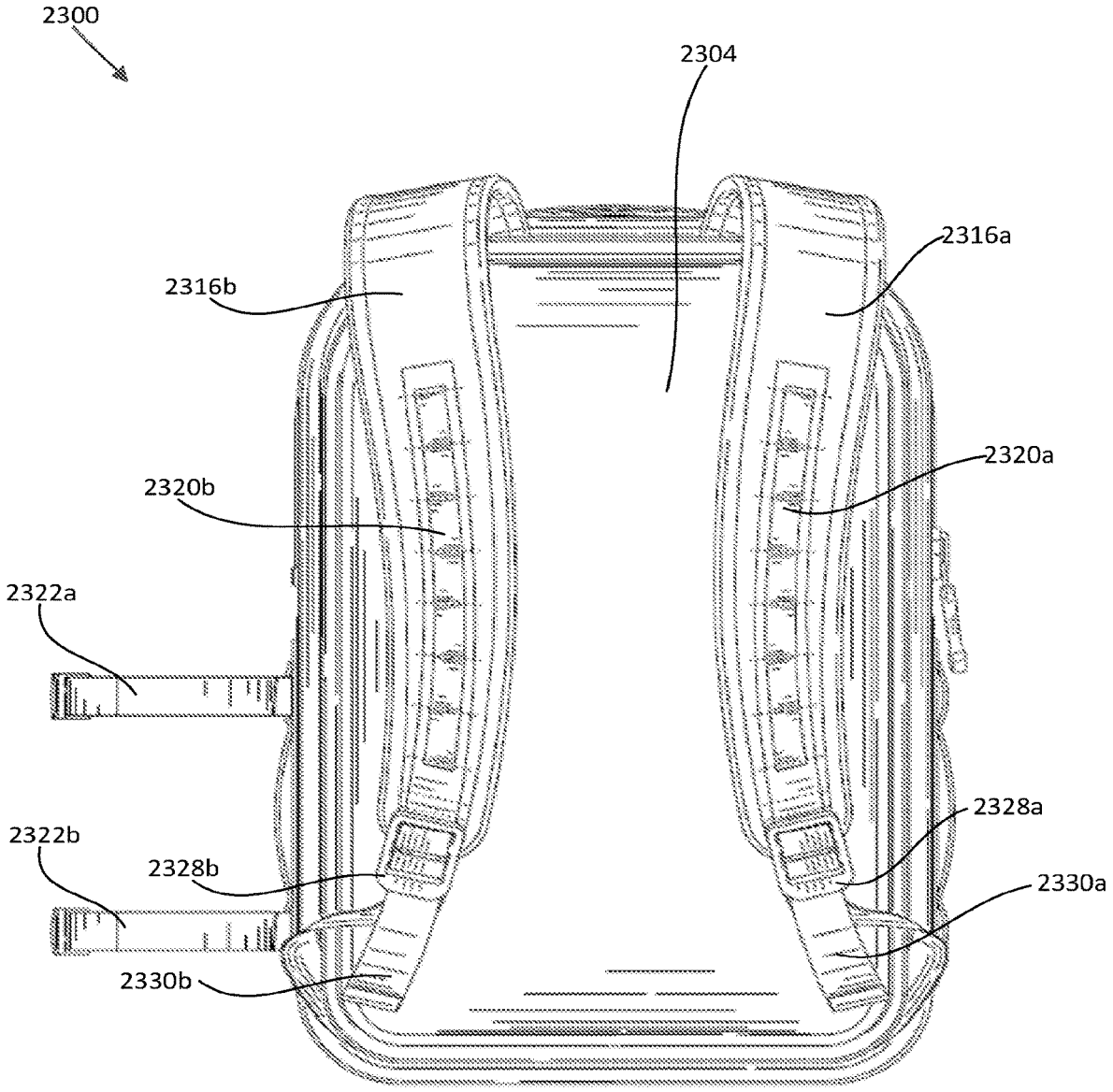
Figure 22:
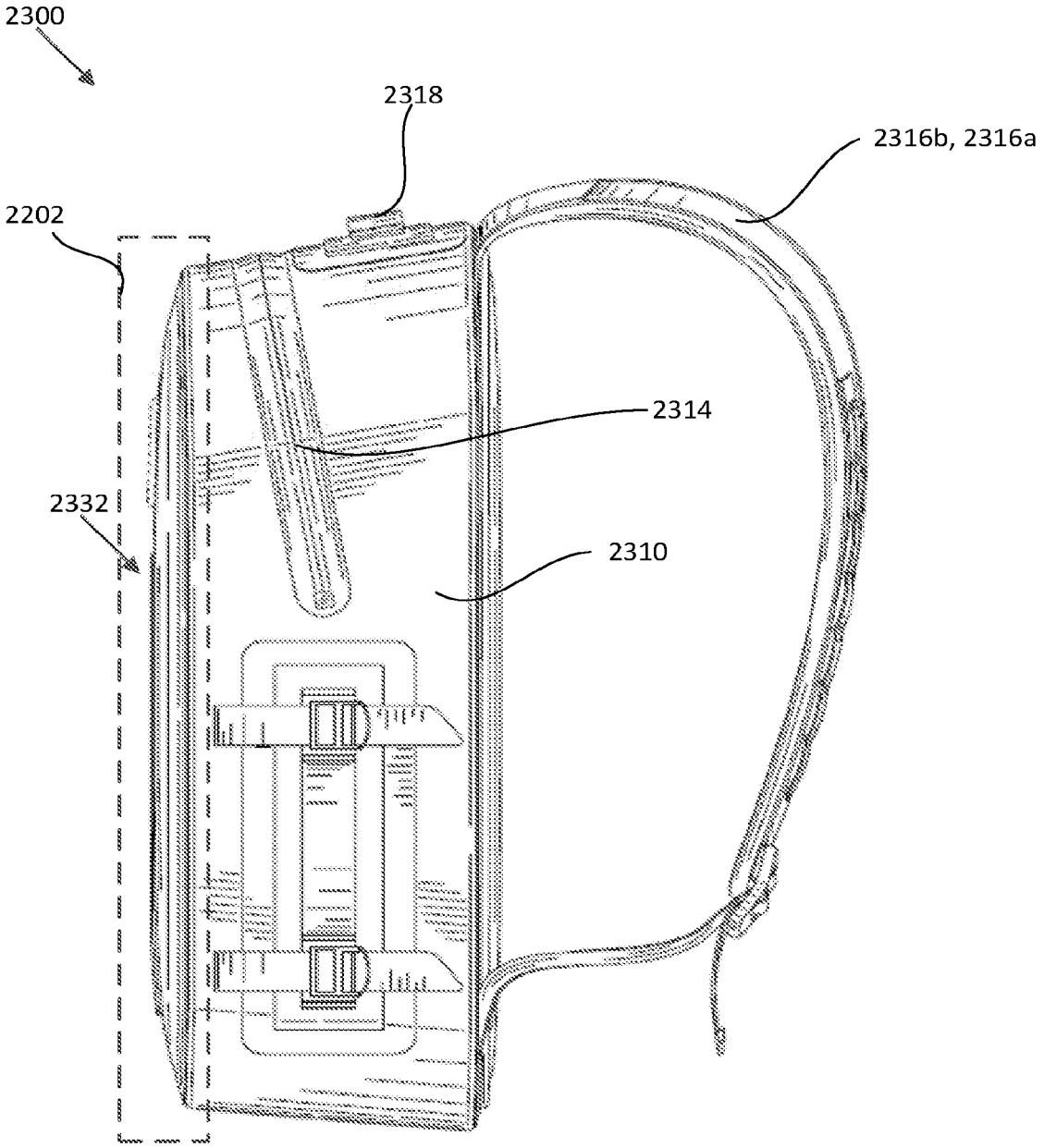
Figure 23:
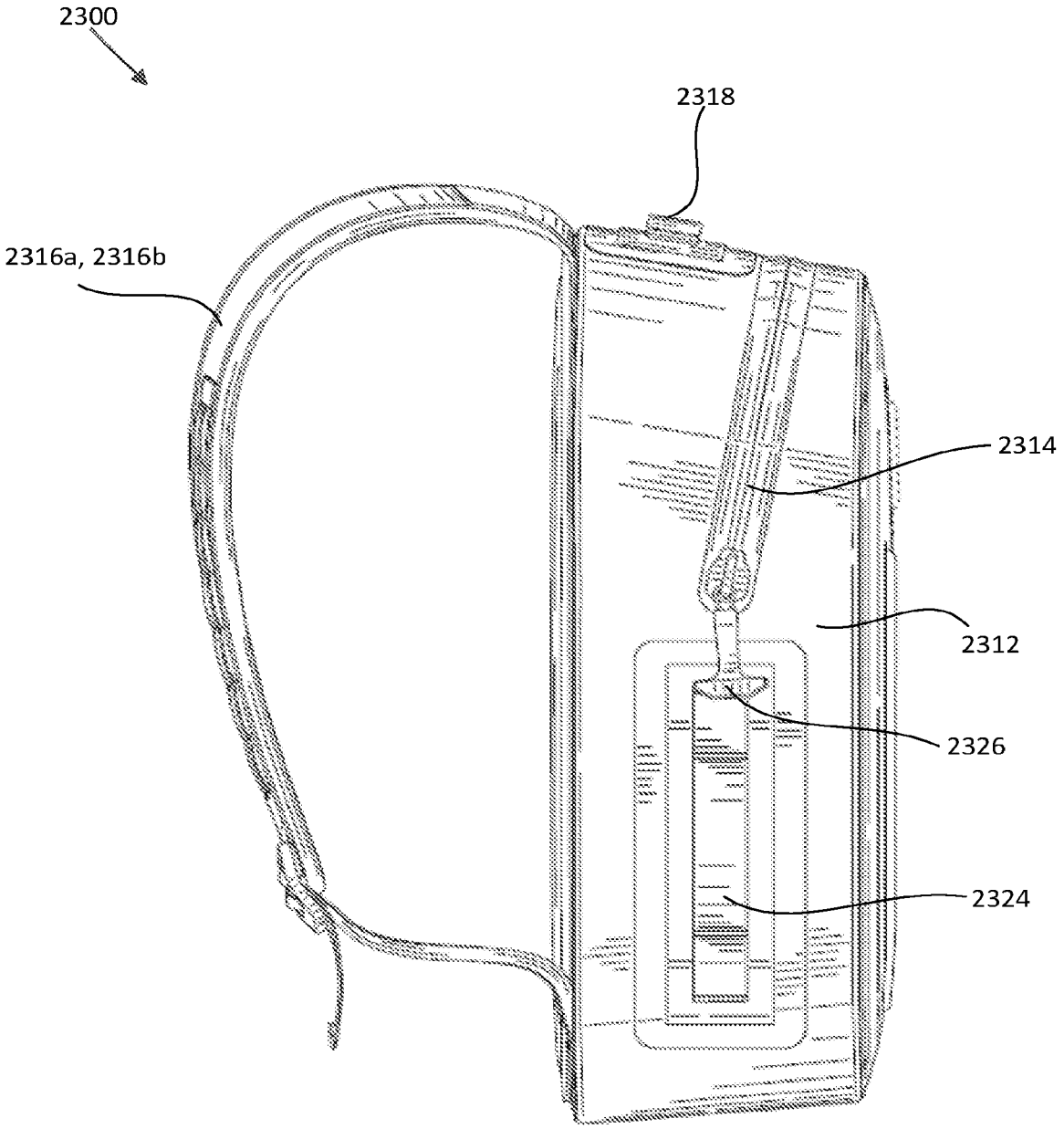
Figure 24:
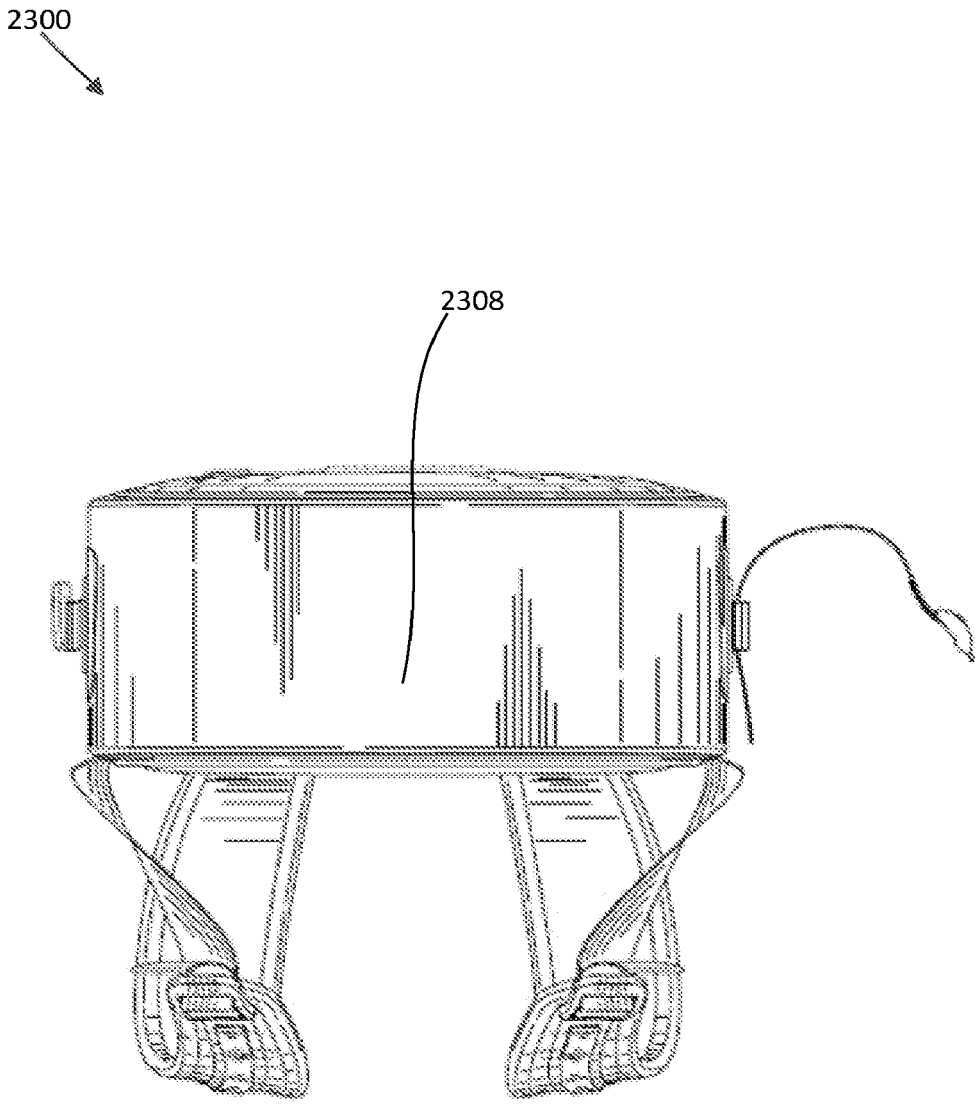

FIGS. 20-24 generally depict an exemplary bag 2300 that can be configured to store various contents. FIG. 20 depicts an isometric view of a front of the bag 2300, FIG. 21 depicts a view of the back of the bag 2300, FIG. 22 depicts a right side of the bag 2300, FIG. 23 depicts a left side of the bag, and FIG. 24 depicts a bottom of the bag 2300, according to one or more aspects described herein. The bag 2300 can include a soft-sided structure, and can generally represent a cuboid, a rectangular prism with rounded corners, a cylinder, an oblong cylinder, or elliptical cylinder, among others. In one implementation, the bag 2300 may be implemented as a backpack, with geometries for ergonomic wear on a user's back when supported over one or two shoulders of the user. Additionally or alternatively, the bag 2300 may be carried by hand, or may be carried as a duffle-type bag. An outer shell of the exemplary bag 2300 can include a front panel 2302, as depicted in FIG. 23, and a rear panel 2304, as depicted in FIG. 24. Additionally, the outer shell of the bag 2300 can include a top sidewall 2306, as depicted in FIG. 23, a bottom sidewall 2308, as depicted in FIG. 24, a right sidewall 2310, as depicted in FIG. 22, and a left sidewall 2312, as depicted in FIG. 23, which form an outer shell of the example bag 2300. The example bag 2300 may also include a closure 2314, otherwise referred to as a primary closure, or primary opening 2314, which may extend, in one example, along a portion of the outer shell. As depicted, the closure 2314 may extend from the right sidewall 2310, over the top sidewall 2306, and to the left sidewall 2312. As discussed below, the outer shell and the closure 2314 can be water proof or water resistant to form a sealed compartment within the bag 2300. The bag 2300 may be formed air tight and can be configured to be submersible under water, while keeping the stored contents dry or substantially dry. In one example, the bag 2300 can be configured to be submersible for a period of up to 30 minutes or greater than 30 minutes while maintaining the contents of the bag completely dry. In one example, the bag 2300 may be configured to be submersible under water, and keep the contents in the sealed compartment dry to a depth of at least 5 feet, at least 10 feet, at least 15 feet, at least 20 feet, at least 50 feet, and for a period of up to 30 minutes, or at least 30 minutes, among others.

The example bag 2300 can include two adjustable shoulder straps 2316*a* and 2316*b*, a top handle 2318, and a side handle 2324 for carrying the example bag 2300. Straps 2316*a* and 2316*b* can, in one example, be identically formed straps, which include the same or identical features and components. In one example, the straps 2316*a* and 2316*b* extend from the top sidewall 2306 to the bottom sidewall 2308. In another example, the straps 2316*a* and 2316*b* extend from the top sidewall 2306 to a lower portion of the left and right sidewalls 2312 and 2310. The example bag 2300 can also include a series of loops 2320*a* and 2320*b* that are located on and extend from outer surfaces of the shoulder strap 2316*a* and 2316*b*, respectively. These loops 2320*a* and 2320*b* may be used to attached items to the bag 2300 using one or more fasteners (not depicted). Additionally or alternatively, the loops 2320*a* and 2320*b* may be configured to limit the extent to which one or more materials of the straps 2316*a* and 2316*b* can stretch. As such, the loops 2320*a* and 2320*b* may be constructed from a less extensible material than one or more others portions of the straps 2316*a* and 2316*b*, and provide a predetermined amount of slack before limiting the stretching of the straps 2316*a* and 2316*b*. Additionally, the bag 2300 may include bottle straps 2322*a* and 2322*b*, which may be configured to fasten an external container, such as a beverage container in the form of a resealable bottle (not depicted), to the bag 2300. It is contemplated that the straps 2322*a* and 2322*b* may fasten around an external container using buckles, hook and loop fasteners, or any other mechanisms for removably attaching two ends of a strap together, or combinations thereof. Moreover, one or more internal pockets (not depicted) may also be included inside the bag 2300 for a compartmentalized storage of various items. Also, although not shown, the bag may also include an inner liner that forms an inner compartment for receiving contents in the bag 2300. Together the inner liner and the outer shell can form an air tight and water proof/water resistant structure.

In one example, the closure 2314 can be substantially waterproof or form a barrier to prevent liquid contents from either entering or exiting the bag 2300. Additionally, the closure 2314 can be impervious to liquid such that the liquid penetration into the closure 2314 is prevented or substantially reduced at any orientation of the bag 2314. The closure 2314 may also be constructed such that it is airtight. In one example, the closure 2314 can be a waterproof zipper assembly and can be watertight up to 7 psi, or up to 15 psi above atmospheric pressure during testing with compressed air. The waterproof zipper assembly 2314 can include a slider body and pull-tab 2326. In one particular example, the waterproof zipper assembly can be constructed with plastic or other non-metallic teeth to prevent injury when retrieving contents from the inner chamber. In another implementation, the closure 2314 may include a mechanism similar to those closure mechanisms described in relation to containers 100, 200, 300, 400, 700, 800, 1400, 1700 and/or closure mechanisms 1800 and/or 1900. Additional suitable example closure mechanisms are disclosed in U.S. application Ser. No. 15/261,407 filed on Sep. 9, 2016, which is fully incorporated by reference herein for any non-limiting purposes.

In certain examples, one or more of the front panel 2302, the rear panel 2304, the bottom sidewall 2308, left sidewall 2312, the right sidewall 2310 and/or the top sidewall 2306 can be formed from a thicker and/or more rigid fabric than other portions of the bag 2300 to provide additional reinforcement in those sections to provide support for the contents stored in the bag 2300. In certain examples, each of the sections can be formed of similar materials. In one example, one or more of the front panel 2302, the rear panel 2304, the bottom sidewall 2308, and left sidewall 2312, the right sidewall 2310 and/or the top sidewall 2306 can be formed of a double laminated TPU nylon fabric. In one example, a nylon fabric can be used as a base material for these portions of the bag and can be coated with a TPU laminate on each side of the fabric. In one example, the TPU nylon fabric used can be 0.6 millimeters thick, or range between 0.2 and 1.5 millimeters in thickness, and can be waterproof. Additionally, it is contemplated that the fabrics used to construct the bag 2300 may incorporate antimicrobial materials to create a mildew-free environment. In one specific example, the nylon can be 840d nylon with TPU. Alternative materials used to manufacture the structure of the bag 2300 may include PVC, TPU coated nylon, coated fabrics, and other weldable and waterproof fabrics.

In certain examples, the materials forming outer shell of the bag 2300, including the front panel 2302, rear panel 2304, the bottom sidewall 2308, the left sidewall 2312, the right sidewall 2310 and/or the top sidewall 2306 can be formed waterproof or water resistant. Also in certain examples, one or more of the front panel 2302, the rear panel 2304, the bottom sidewall 2308, the left sidewall 2312, the right sidewall 2310 and/or the top sidewall 2306 can be provided with a rigid plate or panel to support those sections of the bag 2300. For example, the rigid plate or panel could be formed of a suitable polymer or plastic, such as polyethylene. However, any stiffener material, which may be flexible or substantially inflexible, could be used. Examples may include a thermoformed PE, and/or a TPU injection-molded custom component. The components of the bag 2300, including the front panel 2302, rear panel 2304, the bottom sidewall 2308, the left sidewall 2312, the right sidewall 2310 and/or the top sidewall 2306 can be secured together by stitching, adhesive, polymer welding, and other suitable attachment methods.

The bottom sidewall 2308 of bag 2300 may, in certain examples, be formed of several layers of materials. For instance, the bottom sidewall 2308 may be an EVA compression molded bottom and may include an additional structural layer, which can be formed of a foam material, such as a polyethylene foam, EVA foam or other suitable soft foam, an inner liner, which can be formed of a TPU coated nylon or other suitable fabric, and an outer layer, which can be formed of a TPU coated nylon, or other suitable fabric. Moreover, an additional layer, which is also formed of a foam material, such as a polyethylene foam, EVA foam or other suitable soft foam, can be formed between a padding layer and an outer layer of the bottom sidewall 2308. Also, in certain examples, a similar layered structure to the bottom sidewall 2308 may be implemented in one or more of the front panel 2302, rear panel 2304, the left sidewall 2312, the right sidewall 2310 and/or the top sidewall 2306 and may provide for a more rigid structure such that the bag 2300 maintains its general shape during its use. The additional structure and padding in one or more areas of the bag 2300, e.g. the bottom and sides of the bag 2300, may help to provide additional protection and durability to the bag to prevent rips, tears and scraps in the bag. It is also contemplated that padding layers such as foam can be provided in the regions of the bag 2300 that contact the user's back and shoulders (e.g. rear panel 2304, and straps 2316*a* and 2316*b*) when carrying the bag 2300 as a backpack, to provide comfort to the user when carrying of the bag 2300.

In certain examples, the straps 2316*a* and 2316*b* may not be removable from the bag 2300. In another example, the straps 2316*a* and 2316*b* may be removably attached to the bag 2300 by one or more clips, clasps, buckles, or any others removable attachment device. The straps 2316*a* and 2316*b* may include strap adjusters 2328*a* and 2328*b*, respectively, which may be configured to adjust the length of the straps 2316*a* and 2316*b*. In one implementation, a portion of the series of loops 2320*a* and 2320*b* may be sewn around the strap adjuster 131. Further, lower portions 2330*a* and 2330*b* of the strap 2316*a* and 2316*b* may be looped through a bottom section of the strap adjusters 2328*a* and 2328*b*.

The bag 2300 can be provided with two sets, or series, of loops 2320*a* and 2320*b*, which can be configured to receive items such as carabineers, drinkware, smaller bags, etc. It is contemplated that the loops 2320*a* and 2320*b* can be configured as attachment points, latch points, carrying loops, grab handles, or straps for grasping, holding, or hanging the bag. The loops 2320*a* and 2320*b* can be formed of different lengths and sizes to accommodate different functionality. Also, in certain alternative examples, the loops 2320*a* and 2320*b* can be configured as MOLLE loops or PALS webbing.

In certain examples, the straps 2316*a* and 2316*b*, loops 2320*a* and 2320*b*, and handles 2318 and 2324 can be partially or wholly formed of nylon webbing. Other suitable materials may include polypropylene, neoprene, polyester, Dyneema, Kevlar, cotton fabric, leather, plastics, rubber, or rope. The straps 2316*a* and 2316*b*, loops 2320*a* and 2320*b*, and handles 2318 and 2324 can be attached to the outer shell of the bag 2300 by stitching, adhesive, or polymer welding. It is also contemplated that reinforcement patches of material can be used in the areas where the straps 2316*a* and 2316*b*, loops 2320*a* and 2320*b*, and handles 2318 and 2324 are secured to the outer surface or shell of the bag 2300 to make these areas of the bag 2300 more robust to better support the weight of the bag in these areas. The hardware of the bag 2300 can be designed such that it can withstand many forces. In certain examples, the hardware can withstand 200 lbs. to 300 lbs. of force, and, in other examples, the hardware can be configured to withstand 500 lbs. to 1000 lbs. of force.

In addition to the carrying options previously discussed the bag 2300 can be configured to have only one shoulder strap. Additionally, the bag 2300 may be configured with waist strap, otherwise referred to a hip belt (not depicted) and/or a sternum strap (not depicted). It is further contemplated that the bag 2300, and straps 2316*a* and 2316*b* may have alternative geometries to those depicted in FIGS. 20-24, without departing from the scope of these disclosures.

In certain examples, the volume of the bag 2300 can be 5 liters, 7.5 liters, 10 liters, 15 liters, 20 liters, 25 liters, 30 liters, 35 liters, 40 liters, 45 liters, 50 liters, 75 liters, or 100 liters or more. Other bag sizes are also contemplated. The bag length can range from 25 cm to 100 cm, the bag width can range from 10 to 60 cm, the bag depth can range from 4 to 40 cm. In certain examples, the length to width ratio can range from 1.1 to 3, the width to depth ratio can range from 1 to 10.

In one example, the bag 2300 may additionally include a front pocket 2332, otherwise referred to as a front container 2332, or front vertical pocket 2332. In one example, the front panel 2302 may form a front side of the front pocket 2332, and a resealable opening 2334, otherwise referred to as a secondary closure, or secondary opening 2334, may extend around at least a portion of a front perimeter of the bag 2300, as depicted in FIG. 20. The dashed box 2202, schematically depicted in FIG. 22 on a side view of the bag 2300, indicates a position of the front pocket 2332. In one example, the front pocket 2332 may include a waterproof or water resistant pocket. In certain implementations, the front pocket 2332 may be configured as a container, and may include the elements of one or more of containers 100, 200, 300, 400, 700, 800, 1400, 1700 and/or closure mechanisms 1800 and/or 1900, as previously described in these disclosures. As such, in certain examples, the front pocket of the bag 2300 may be substantially rigid or semi-rigid (e.g. when the front pocket 2332 includes elements of container 100, 200, 300, 400, 700, 800, 1400, and/or 1700), while another portion of the bag 2300 may be substantially non-rigid and deformable. Alternatively, both the front pocket 2332 and the additional portions of the bag 2300 may be constructed as rigid or partially rigid structures, or as non-rigid, deformable structures. It is further contemplated that the opening 2334 of the front pocket 2332 may include any of the opening mechanisms described in relation to containers 100, 200, 300, 400, 700, 800, 1400, 1700 and/or closure mechanisms 1800 and/or 1900, among others. Additionally or alternatively, closure 2334 may include the same or similar elements to those described in relation to closure 2314.

Figures 25A, 25B:
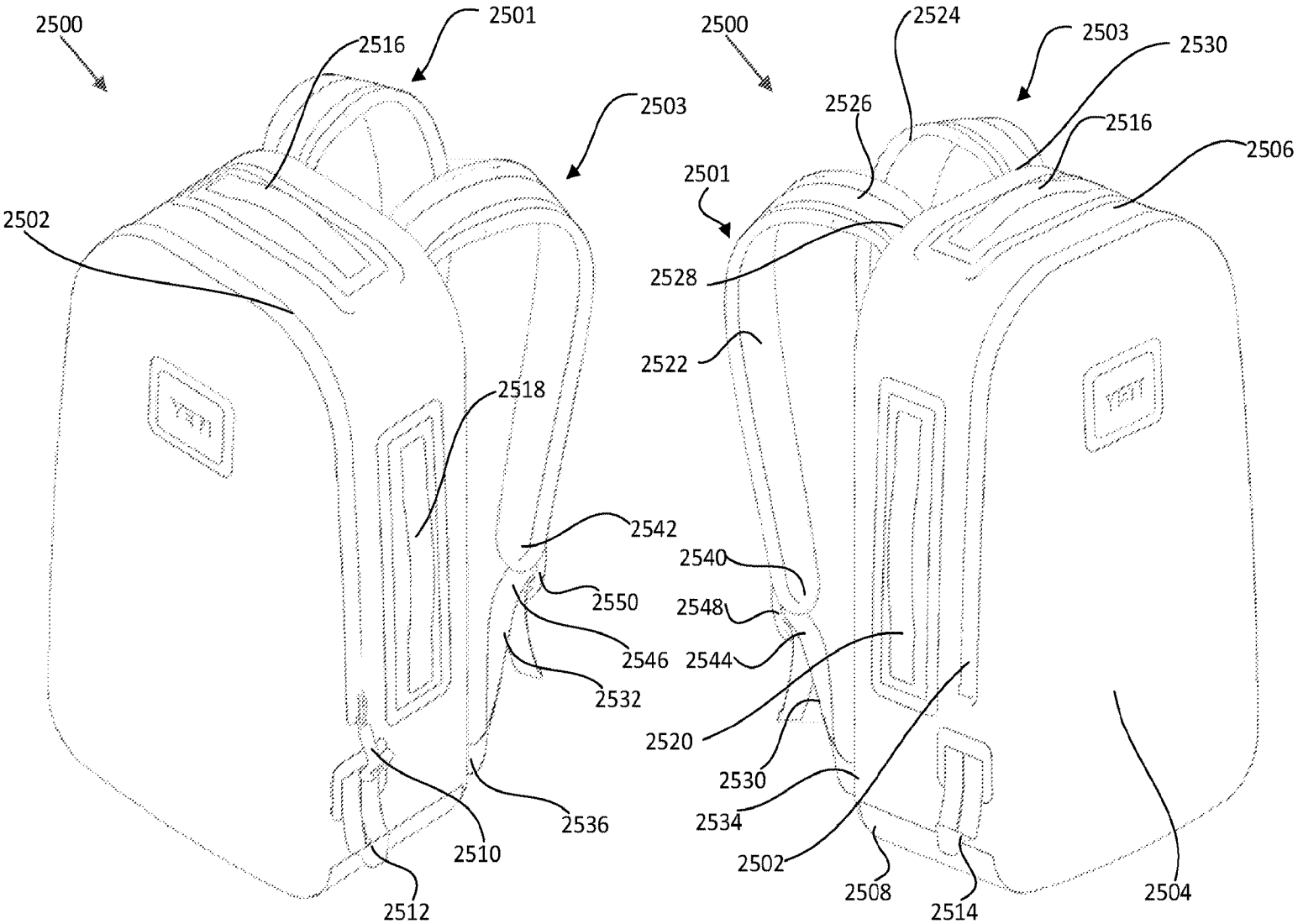
FIGS. 25A-25C depict another implementation of a bag, according to one or more aspects described herein.

FIGS. 25A and 25B depict another implementation of a bag 2500, according to one or more aspects described herein. In particular, FIG. 25A depicts an isometric view of a right side of the bag 2500, and FIG. 25B depicts an isometric view of a left side of the bag 2500. In one implementation, the bag 2500 is configured as a backpack having shoulder straps 2501 and 2503, and may be used to store various contents in a compartment 2502. The shoulder straps 2501 and 2503 may include padded upper strap portions 2522 and 2524, which may constructed using, in one example, multiple layers of material, including a foam core surrounded by an abrasion resistant outer polymeric shell. As such, the foam core may include one or more of ethylene-vinyl acetate, low-density polyethylene, nitrile rubber, polychloroprene foam, polyimide foam, polypropylene foam, polyurethane foam, polyvinyl chloride foam, silicone foam, and microcellular foam, or combinations thereof. Additionally, the padded upper strap portions 2522 and 2524 may include outer webbing that is sewn onto the padded upper strap portions 2522 and 2524 to form a reinforcement element and/or multiple loops 2526.

It is contemplated that the padded upper strap portions 2522 and 2524 may include any number of loops 2526, which may have any physical dimensions. These loops may be constructed of nylon webbing. Additionally, or alternatively, the loops 2526 may be constructed from other materials, such as polypropylene, neoprene, polyester, Dyneema, Kevlar, cotton fabric, leather, plastics, rubber, or rope. In one implementation, the loops are configured to be used to attach items (e.g., carabineers, dry bags, among others) to the bag 2500. Additionally or alternatively, the loops 2526 are configured to limit the extent to which the padded upper strap portions 2522 and 2524 may be expanded. As such, the padded upper strap portions 2522 and 2524 may be constructed from materials configured to deform and expand to provide shock absorption when the bag 2500 is worn on a user's back. When the bag 2500 is not loaded or worn by a user, the padded upper strap portions 2522 and 2524 may be in a contracted position and the webbing/loops 2526 may have an amount of slack that loops outward from the padded upper strap portions 2522 and 2524. When worn by a user, the weight of the bag 2500 may intermittently or continuously cause the padded upper strap portions 2522 and 2524 to expand, and the loops 2526 may be repositioned as taut and proximate the outer surfaces of the padded upper strap portions 2522 and 2524. As such, the loops 2526 may be configured to limit the extent to which the padded upper strap portions 2522 and 2524 may expand, and thereby prevent overexpansion and damage to the padded upper strap portions 2522 and 2524, while also providing shock absorption functionality.

In one example, the padded upper strap portions 2522 and 2524 may be coupled to a top portion of a back panel of the bag 2500 at proximal ends 2528 and 2530. It is contemplated that the padded upper strap portions 2522 and 2524 may be coupled to the back panel of the bag 2500 at the proximal ends 2528 and 2530 by sewing, gluing, or one or more fastener elements, among others. The shoulder straps 2501 and 2503 may additionally include lower adjustment straps 2530 and 2532. The lower adjustment straps 2530 and 2532 may be coupled to a bottom portion of the back panel of the bag 2500 at proximal ends 2534 and 2536. In one example, the lower adjustment straps 2530 and 2532 may be constructed from a nylon webbing. However, it is contemplated that the lower adjustment straps 2530 and 2532 may be constructed from additional or alternative polymers, metals, alloys, ceramics, or fiber-reinforced materials, among others.

Distal ends 2540 and 2542 of the padded upper strap portions 2522 and 2524 may be adjustably coupled to distal ends 2544 and 2546 of the lower adjustment straps 2530 and 2532 by adjustment buckles 2548 and 2550. In one example, the adjustment buckles 2548 and 2550 may be constructed from one or more of a polymer, a metal, an alloy, a ceramic, or a fiber reinforced material, among others.

Figure 25C:
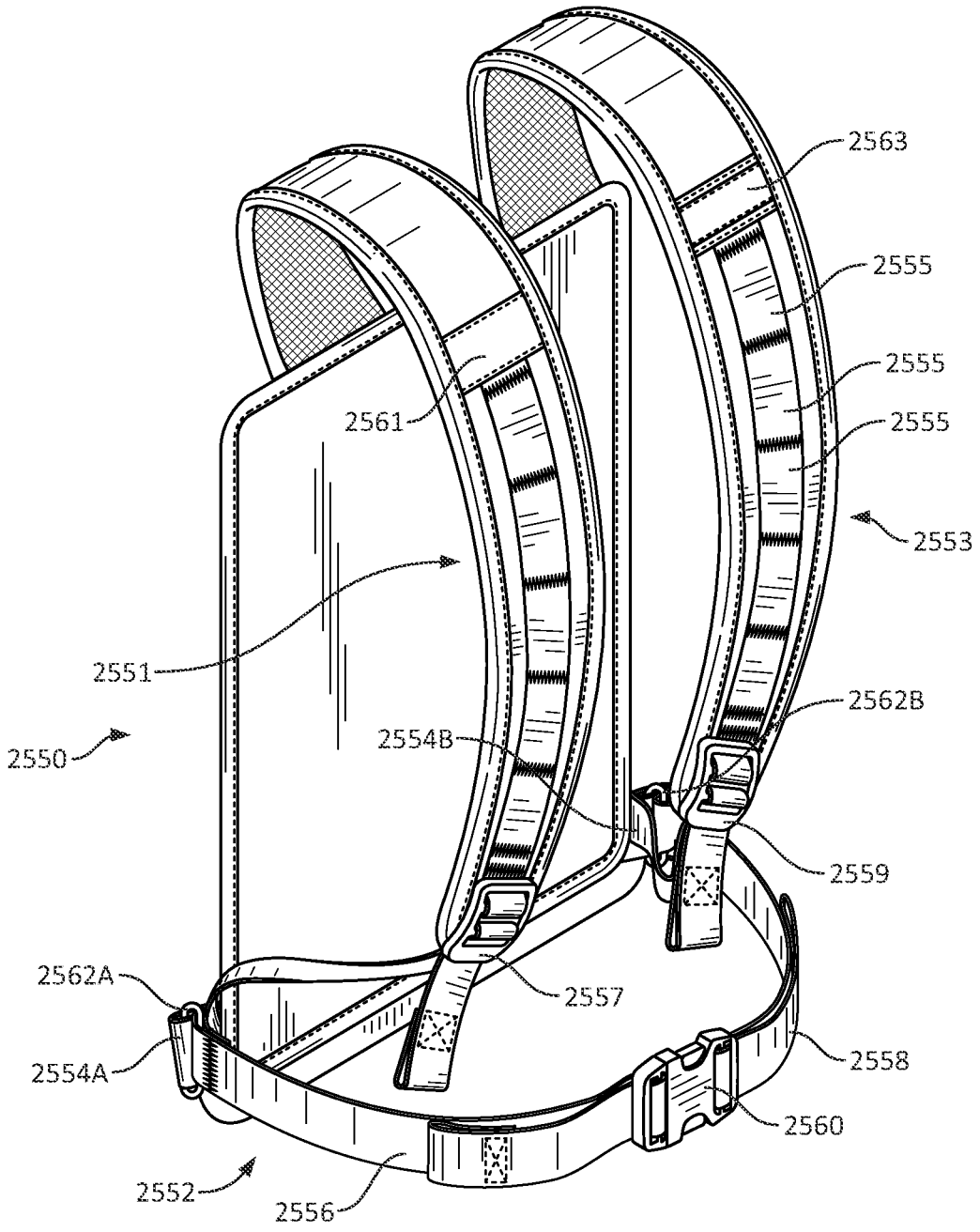

The bag 2500 may additionally include lower attachment loops proximate the proximal ends 2534 and 2536 of the lower adjustment straps 2530 and 2532. The lower attachment loops may be sewn into the sides of the back panel of the bag 2500, and may be constructed from a material similar to the lower adjustment straps 2530 and 2532. It is contemplated that the lower attachment loops may be constructed from a nylon webbing material. However, additional or alternative materials may be used, without departing from the scope of these disclosures. In one example, the lower attachment loops may be used as anchor points for attachment of a waist strap, as descripted with reference to FIG. 25C FIG. 25C schematically depicts one implementation of a back portion 2550 of a bag. In one example, the back portion 2550 may be used on bag 2500. However, similar elements may be used on bags 2300 and 2600. As depicted, a waist strap 2552 is removably attached to the lower attachment loops 2554A and 2554B. In one example, the waist strap 2552 includes a first strap portion 2556 that is removably coupled to a second strap portion 2558 by a buckle 2560. It is contemplated that the first and second strap portions 2556 and 2558 may be constructed from a nylon webbing, similar to lower adjustment straps 2530 and 2532. However, additional or alternative polymeric, metallic, alloy or ceramic materials, or combinations thereof, may be used in the first and second strap portions 2556 and 2558, without departing from the scope of these disclosures. It is further contemplated that the buckle 2560 may include any removable coupling implementation, without departing from the scope of these disclosures.

The waist strap 2552 may be removably attached to the lower attachment loops 2554A and 2554B by two split-ring fasteners 2562A and 2562B. In one example, the split-ring fasteners 2562A and 2562B may be constructed from aluminum, and may include an elongated loop element with a gap through which the lower attachment loops 2562A and 2562B are configured to be inserted. In other implementations, the split-ring fasteners 2562A and 2562B may be constructed from another metal, alloy, polymer, fiber-reinforced material, or ceramic, or combinations thereof. In one implementation, the fasteners 2562A and 2562B may additionally or alternatively include buckles, clasps, clips, hook and loop fasteners, or ties. In another implementation, the waist strap 2552 may be sewn onto the bag 2500 such that it is not removable.

FIG. 25C further depicts an alternative implementation of shoulder straps 2551 and 2553. The shoulder straps 2551 and 2553 may be similar to shoulder straps 2501 and 2503, and include one or more layers of padding and/or outer webbing materials provided for structural load-bearing properties and abrasion resistance. Additionally, the shoulder straps 2551 and 2553 may include a series multiple loops (a portion of the loops are labelled as loops 2555 in FIG. 25C). It is contemplated that the shoulder straps 2551 and 2553 may include any number of loops 2555, without departing from the scope of these disclosures. In one example, the series of loops 2555 extends from the adjustment buckles 2557 and 2559 to reinforcement patches 2561 and 2563 that extend across a width of the shoulder straps 2551 and 2553.

Figure 28B:
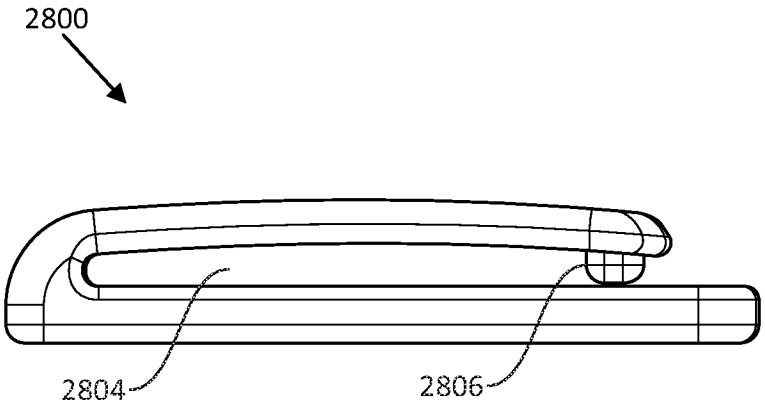
FIGS. 28A and 28B depict a sternum strap buckle, according to one or more aspects described herein.
Figure 28A:
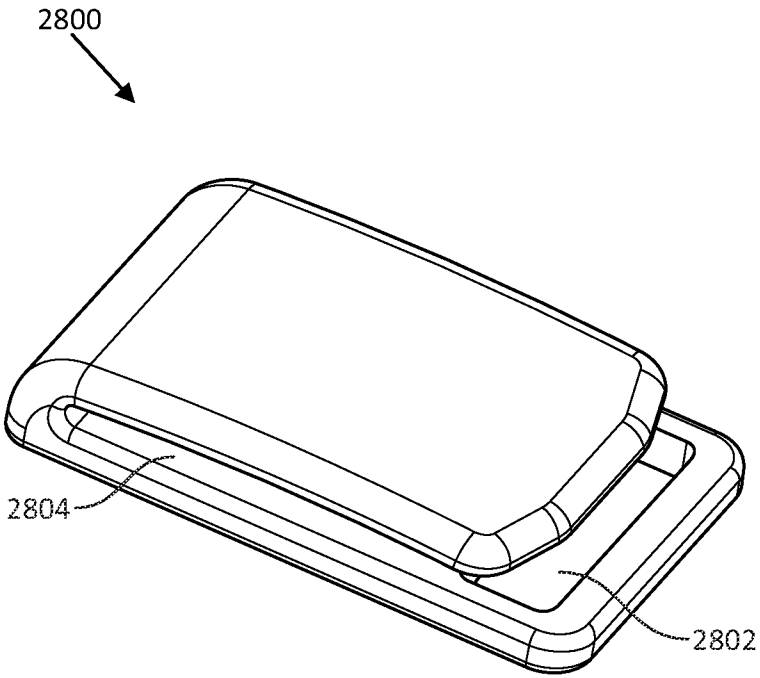

The shoulder straps of bags 2300, 2500, and 2600 (e.g. shoulder straps 2501, 2503, 2551, 2553, 2601, and 2603) may be removably coupled to a sternum strap (not depicted). This sternum strap may be configured to be removably coupled to one or more of the loops of the shoulder straps, such as loops 2526 and/or 2555. In one example, the removable coupling may use a sternum strap buckle 2800, as depicted in FIGS. 28A and 28B. Sternum strap buckle 2800 may include a slot 2802 for receiving a portion of a sternum strap, and a hook 2804 configured to be removably coupled to webbing loops, such as 2526 and/or 2555. Additionally, the sternum strap buckle 2800 includes a tooth 2806 that is configured to prevent the shoulder strap loops, such as loops 2526 and/or 2555 from being inadvertently uncoupled from the hook 2804. In one example, when the hook 2804 is compressed, the tooth 2806 is configured to drop into the slot 2802. It is contemplated that the buckle 2800 may be constructed from a thermoplastic, such as polyoxymethylene/acetal. In other implementations, the buckle 2800 may be constructed from one or more additional or alternative polymers, metals, alloys, ceramics, or fiber-reinforced materials, among others.

In one example, the zippered compartment 2502 of the bag 2500 may include one or more item organization structures. In one example, the item organization structures may include a patch that is coupled to one or more internal sidewalls of the zippered compartment 2502. The patch may be coupled to the one or more internal sidewalls of the zippered compartment 2502 by one or more of sewing, gluing, or welding. The patch may include one or more of hook and loop fasteners configured to be removably coupled to corresponding one or more hook and loop fasteners of items to be tethered within the zippered compartment 2502. It is contemplated that where hook and loop fasteners are described, it may include an area or element having all hook fastener elements, all loop fastener elements, or a combination of both, without departing from the scope of these disclosures. For example, a key ring having a hook and loop tab may be removably coupled to the hook and loop elements of the internal patch. These item organization structures may additionally or alternatively include one or more internal pockets, pouches sleeves, straps, ties, elastic straps, netting, or flexible, partially rigid or fully rigid divider elements, among others. The item organization structures may have openings that may be closable using any closure mechanism, including, among others, one or more zippers, magnets, pull-ties, or hook and loop fasteners, or combinations thereof. The item organization structures may have any dimensions such that they may be configured to store items of different sizes. Further, the item organization structures may include padded sidewalls and/or edges to provide protection to contents stored therein. In one example, the zippered compartment 2502 of the bag 2500 may include a padded sleeve configured to store a laptop, tablet or phone device, among others. Additionally or alternatively, the zippered compartment 2502 of the bag 2500 may include a pouch configured to hold a beverage container. It is contemplated that the item organization structures may additionally include insulating elements configured to reduce a rate of heat transfer of items held herein. For example, the pouch configured to hold a beverage container may include one or more insulating elements.

It is contemplated, however, that the bag 2500 may be configured as a messenger bag, or other carry-bag type, without departing from the scope of these disclosures. In one implementation, the bag 2500 may be use materials and methodologies similar to those described in relation to bag 2300. Accordingly, the zippered compartment 2502 may include any of the opening mechanisms described in relation to containers 100, 200, 300, 400, 700, 800, 1400, 1700 and/or closure mechanisms 1800 and/or 1900, among others.

In one example, bag 2500 may include soft-sided, semi-rigid, or rigid sidewalls (e.g. sidewalls 2504 and 2506), or combination thereof. Additionally or alternatively, the bag 2500 may include one or more areas that include reinforcing and/or more highly water resistant or durable materials, such as area 2508. Further, the bag 2500 may be constructed from any materials, without departing from the scope of these disclosures. It is contemplated that the bag 2500, and closure mechanism of the compartment 2502 may be highly water resistant and/or waterproof. In one example, it is contemplated that the compartment 2502 may have a zippered closure that has a pull tab 2510, and two zipper opposers 2512 and 2514. In one example, the bag 2500 may additionally include three or more carry handles 2516, 2518, and 2520.

Figure 26B:
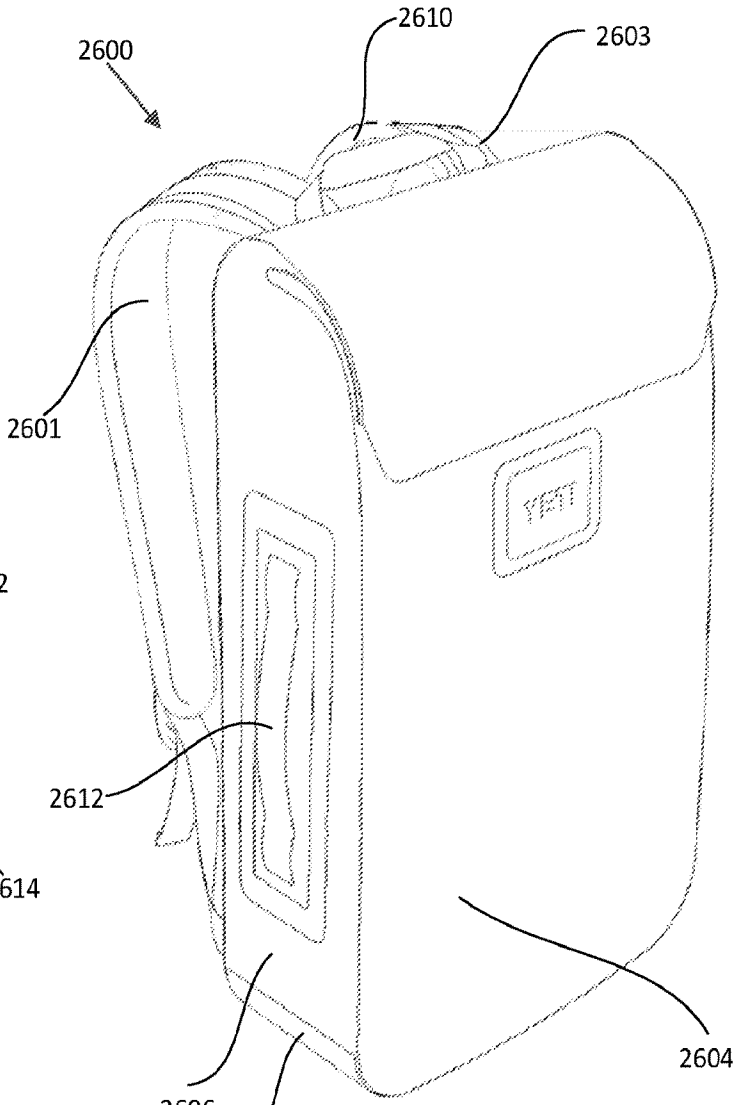
FIGS. 26A and 26B depict another implementation of a bag, according to one or more aspects described herein.
Figure 26A:
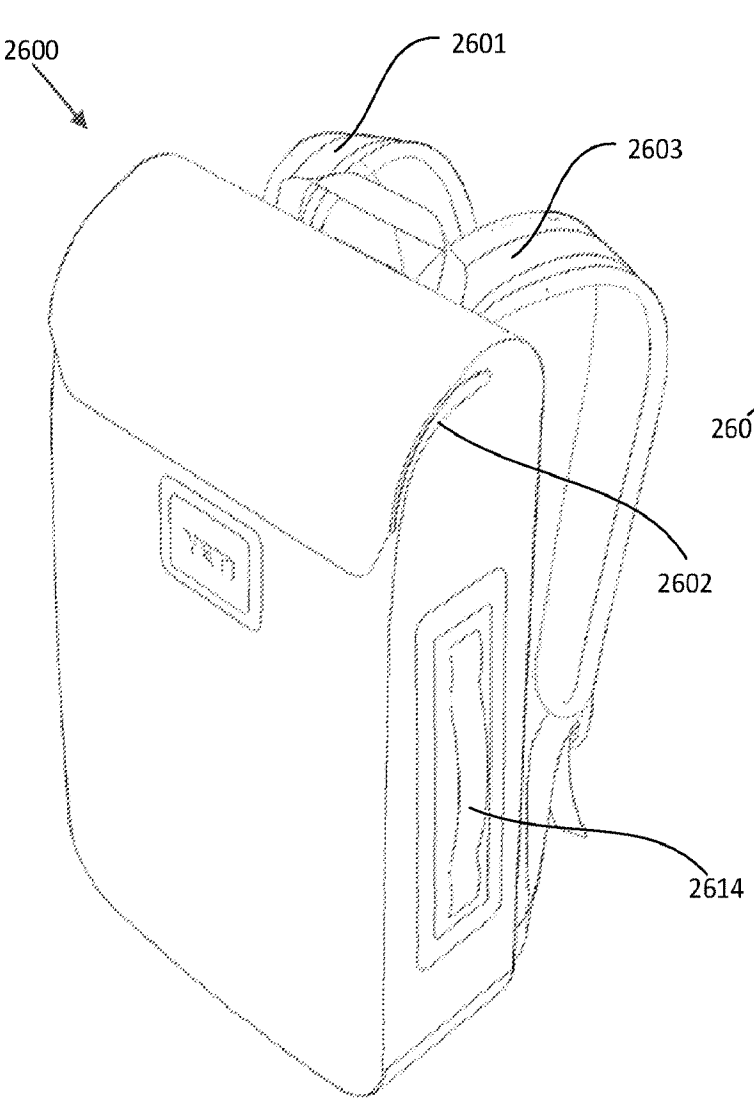

FIGS. 26A and 26B depict another implementation of a bag 2600, according to one or more aspects described herein. In particular, FIG. 26A depicts an isometric view of a right side of the bag 2600, and FIG. 26B depicts an isometric view of a left side of the bag 2600. In one implementation, the bag 2600 is configured as a backpack, and include shoulder straps 2601 and 2603, and may be used to store various contents in a compartment 2602. Accordingly, FIGS. 26A and 26B depict the compartment 2602 in a closed configuration. In other examples, bag 2600 may be configured as a messenger bag or any other type of carry bag. In one specific implementation, the compartment 2602 of bag 2600 may use one or more of the mechanisms described in relation to containers 800 and 1400 that include a folding closure mechanism in combination with magnetic fastener elements and/or hook and loop fastener elements.

Similar to bag 2500, bag 2600 may include soft-sided, semi-rigid, or rigid sidewalls (e.g. sidewalls 2604 and 2606), or combination thereof. Additionally or alternatively, the bag 2600 may include one or more areas that include reinforcing and/or more highly water resistant or durable materials, such as area 2608. Further, the bag 2600 may be constructed from any materials, without departing from the scope of these disclosures. It is contemplated that the bag 2600, and closure mechanism of the compartment 2602 may be highly water resistant and/or waterproof. In one implementation, the bag 2600 may include three or more carry handles 2610, 2612, and/or 2614. However, less than three, or more than three carry handles may be used, without departing from the scope of these disclosures.

Figure 27B:
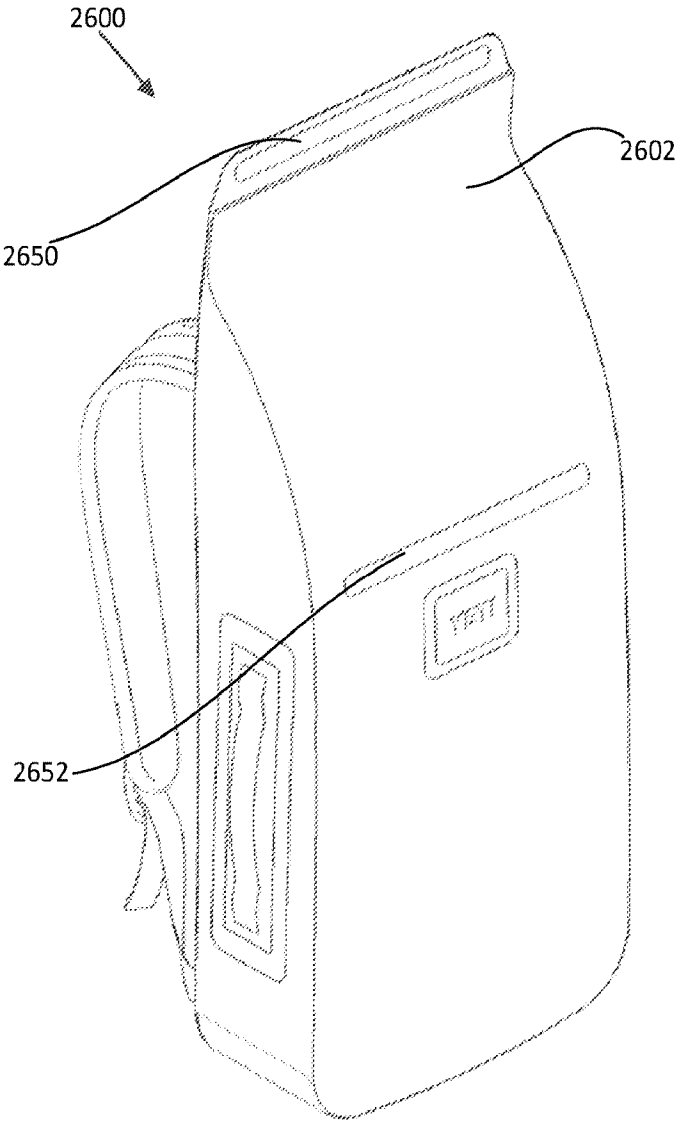
FIGS. 27A and 27B depict isometric views of the bag of FIGS. 26A and 26B, according to one or more aspects described herein.
Figure 27A:
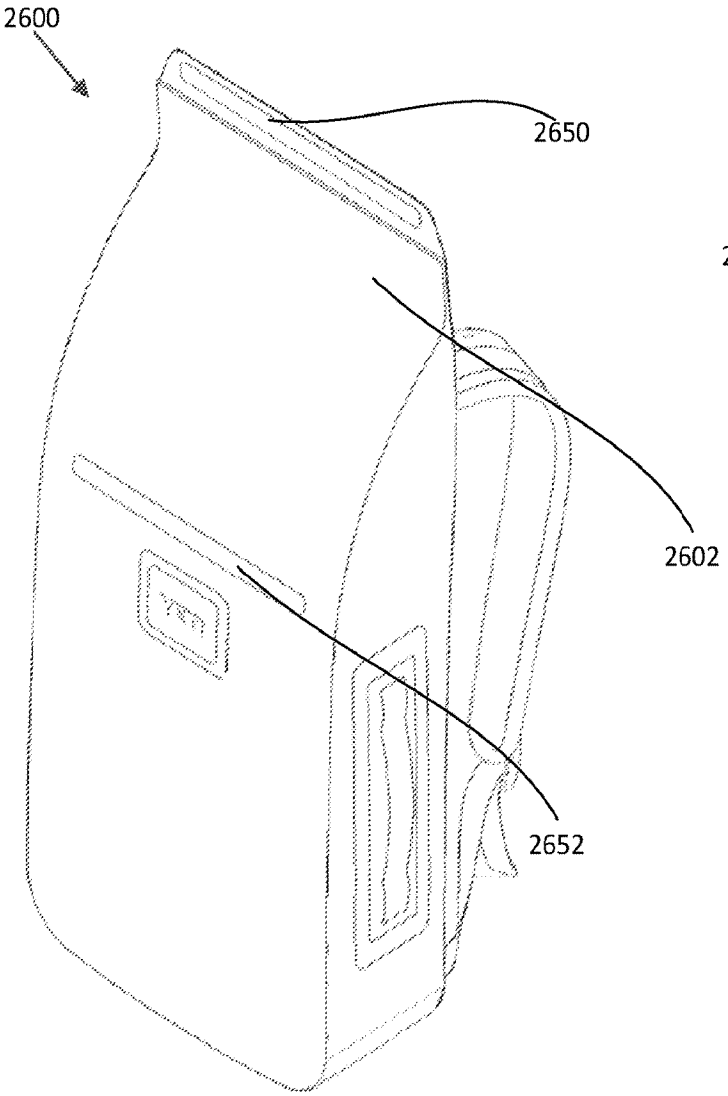

FIGS. 27A and 27B depict isometric views of the bag 2600 with the compartment 2602 in a partially open configuration similar to that described in relation to FIG. 13A. In one example, the bag 2600 includes a first fastener element 2650 that is configured to removably couple to a second fastener element 2652. In one example, the first and second fastener elements 2650 and 2652 may include hook and loop fasteners, and/or one or more magnetic fastener elements.

Figure 29:
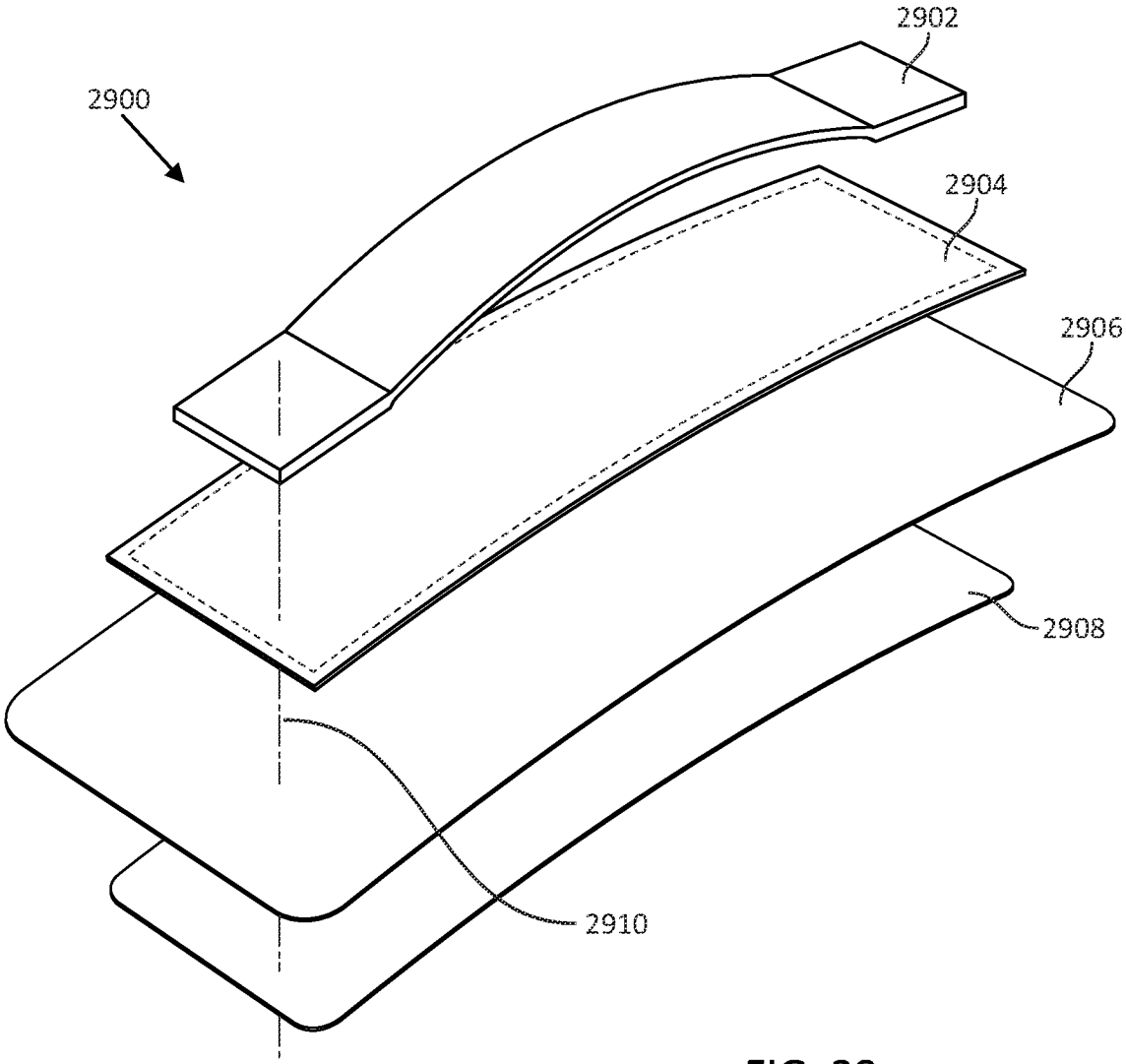
FIG. 29 schematically depicts an exploded isometric view of a handle structure, according to one or more aspects described herein.

FIG. 29 schematically depicts an exploded isometric view of a handle structure 2900. This handle structure 2900 may be used for one or more of handles 2318, 2516, 2518, 2520, 2612 and/or 2614, among others. In one implementation, the handle structure 2900 provides added rigidity to the structure of the bags 2300, 2500, and/or 2600, among others. The handle structure 2900 may include a folded webbing, or grip structure 2902. In one example, the folded webbing 2902 may encapsulate a layer of foam. In one implementation, the folded webbing 2902 may be constructed from a flexible polymer, such as a nylon webbing. However, additional or alternative materials may be used, without departing from the scope of these disclosures. The folded webbing structure 2902 may be coupled to webbing layer 2904. In one example, the webbing layer 2904 may be constructed from a same material as the folded webbing 2902. However, additional or alternative materials may be used. The webbing layer 2904 may be coupled to fabric layer 2906. In one example, the fabric layer 2906 may be constructed from a dual coated 1608 Denier fabric, such as nylon or polyester. It is contemplated that different materials and/or different linear densities may be used, without parting from the scope of these disclosures. The fabric layer 2906 may be coupled to a rigid or partially rigid polymeric board 2908. In one specific example, the polymeric board 2908 may be constructed from a polyethylene material and may have a thickness of approximately 3 mm. However, additional or alternative polymeric board 2908 materials and/or thicknesses may be used, without departing from the scope of these disclosures. Element 2910 schematically depicts a stitching path that may be used to couple the elements 2902-2908. However, in addition to or as an alternative to stitching, the elements 2902-2908 may be coupled to one another by one or more staples, rivets, screws, adhesives, or laser welds, among others.

In another example, the handle structure 2900 and/or handles 2318, 2516, 2518, 2520, 2612 and/or 2614, may include elements of the handles (e.g. handles 210, 212, 3210, 4210, 5216) described in U.S. application Ser. No. 15/261,407, filed 9 Sep. 2016, the entire contents of which are incorporated herein by reference.

Figure 30:
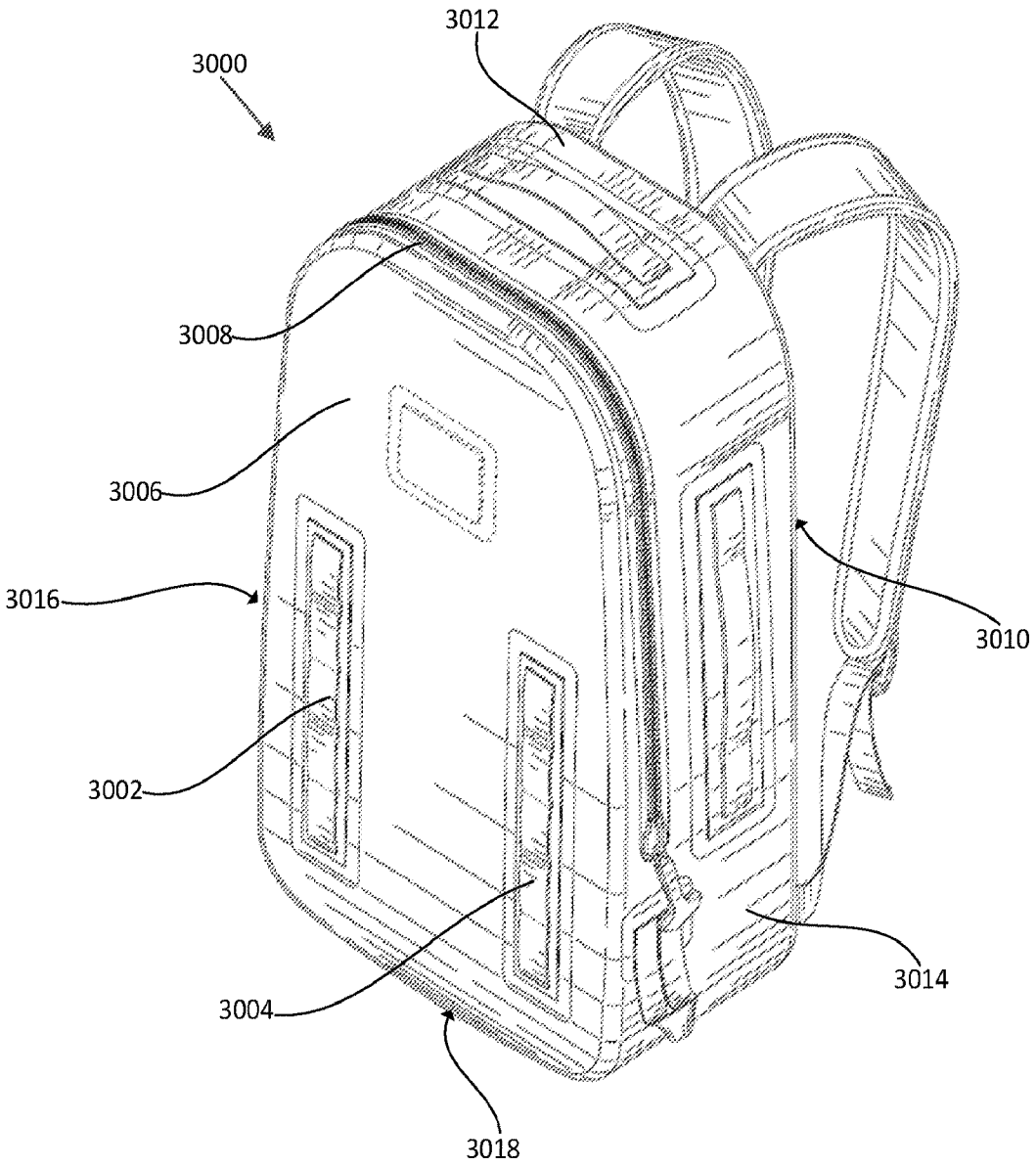
FIG. 30 depicts an isometric view of another implementation of a bag, according to one or more aspects described herein.

FIG. 30 depicts an isometric view of another implementation of a bag 3000, according to one or more aspects described herein. Bag 3000 may include an outer shell that has a front panel 3006, a rear panel 3010, a top sidewall 3012, a left sidewall 3014, a right sidewall 3016, and a bottom sidewall 3018. In one example, bag 3000 may be similar to bag 2500, and additionally include a first and a second series of fabric loops 3002 and 3004, respectively, on a front panel 3006 of the bag 3000. The bag 3000 may include a closure 3008 that is used to access an internal storage compartment, which may be similar to closure 2314 and/or storage compartment 2502. It is contemplated that any of the materials and constructions described in relation to bag 2500 may be used for bag 3000, without departing from the scope of these disclosures. The series of fabric loops 3002 and 3004 may otherwise be referred to as webbing loops, and may be formed of one or more webbing materials that are sewn onto the front panel 3006. It is contemplated that any webbing material, or alternative materials, may be used to construct the fabric loops 3002 and 3004. In one example, the series of fabric loops 3002 and 3004 may be used to attach items to the bag 3000.

Figure 31:
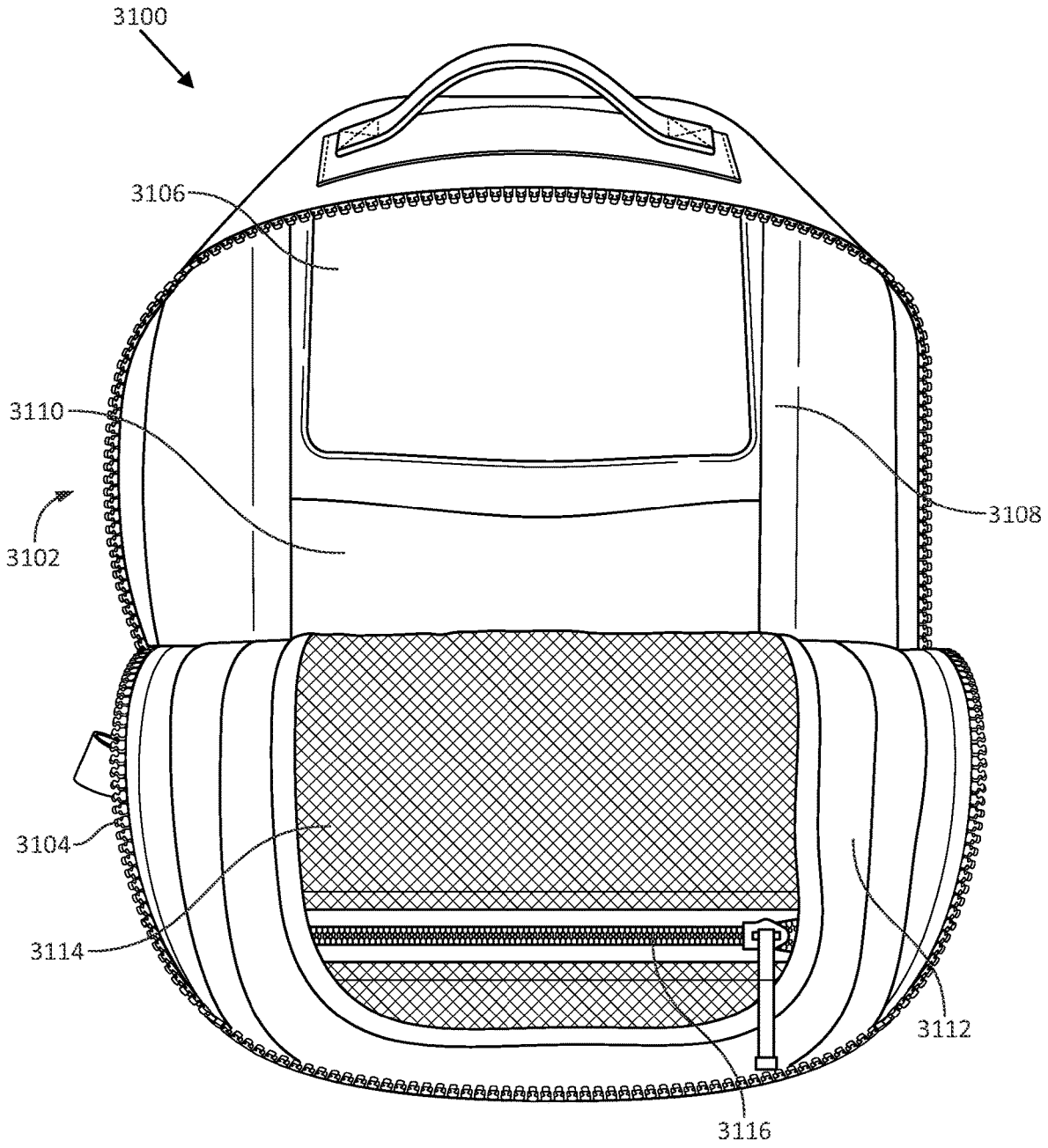
FIG. 31 depicts a view of a bag with an open storage compartment, according to one or more aspects described herein.

FIG. 31 depicts a view of a bag 3100 with an open storage compartment 3102, according to one or more aspects described herein. Itis contemplated that the bag 3100 may be constructed from one or more polymer materials. In one implementation, the bag 3100 may be constructed from any one or more materials previously described in these disclosures. The storage compartment 3102 may be similar to the storage compartment 2502, and include a closure 3104 configured to provide partial or full resealable sealing of the storage compartment 3102. In one example, the closure 3104 may include a zipper closure. It is contemplated that any zipper type having any dimensions may be used, without departing from the scope of these disclosures. Bag 3100 may be similar to bag 2500 and 3000, and include any of the construction materials and features previously described.

In one example, the storage compartment 3102 of bag 3100 may include a patch 3106 that is coupled to a back internal sidewall 3108 of the zippered compartment 3102. The patch 3106 may be coupled to the back internal sidewall 3108 by one or more of sewing, gluing, or welding, among others. The patch 3106 may include one or more of hook and loop fasteners configured to be removably coupled to corresponding one or more hook and loop fasteners of items to be tethered within the zippered compartment 3102. It is contemplated that where hook and loop fasteners are described, it may include an area or element having all hook fastener elements, all loop fastener elements, or a combination of both, without departing from the scope of these disclosures.

The storage compartment 3102 of bag 3100 may additionally include a slip pocket or sleeve 3110 that is attached to the back internal sidewall 3108. The slip pocket 3110 may be formed of a same material as the back internal sidewall 3108, and may be sewn, glued, and/or welded, among others, to the back internal sidewall 3108. In one example, a front internal sidewall 3112 of the storage compartment 3102 may include a zippered mesh pocket 3114 that provides a storage compartment that is closable with a zipper 3116 that extends along a top portion of the mesh pocket 3114.

An example bag may include an outer shell made from a water-resistant material, which has a front panel, a rear panel, a top sidewall, a bottom sidewall, a left sidewall, a right sidewall. The bag may also include a pair of adjustable straps that are attached to the outer shell, and a first that extends around a portion of the left sidewall, top sidewall, and right sidewall. The first closure can move from an open position to a closed position to resealably seal a first internal pocket of the bag. A second closure extends around a portion of the front panel, and moves from an open position to a closed position to resealably seal a front container. The front container can include an opening at a top of the container that extends into a storage compartment, and a closure mechanism. The closure mechanism may include a first magnetic strip that is coupled to a first internal surface at a front edge of the opening. Additionally, the closure mechanism may include a second magnetic strip that is coupled to a second internal surface at a back edge of the opening. The first magnetic strip may be magnetically attracted to the second magnetic strip to resealably seal the opening couple the first fastener element to the second fastener element.

In one example, the first magnetic strip on the second magnetic strip may be hingedly coupled at the respective front and back edges of the opening.

In another example, at least one of the first magnetic strip and the second magnetic strip may be hingedly coupled at the respective front and back edges of the opening.

In yet another example, the first fastener element may be removably coupled to the second fastener element by hook and loop fasteners.

The first fastener element and the second fastener element may include magnets.

Another example bag may include an outer shell made from a water-resistant material, which has a front panel, a rear panel, a top sidewall, a bottom sidewall, a left sidewall, a right sidewall. The bag may also include a pair of adjustable straps that are attached to the outer shell, and a first that extends around a portion of the left sidewall, top sidewall, and right sidewall. The first closure can move from an open position to a closed position to resealably seal a first internal pocket of the bag. A second closure extends around a portion of the front panel, and moves from an open position to a closed position to resealably seal a front container. The front container may include a front shell, a front frame extending around an internal perimeter of the front shell, a back shell, a back frame extending around an internal perimeter of the back shell, and hingedly coupled to the front frame at a bottom surface. The container may also include a closure mechanism configured to resealably seal the back shell to the front shell. The closure mechanism may additionally include a front magnetic strip extending around at least a first portion of the front frame, and a back magnetic strip extending around at least a first portion of the back frame. Additionally, the closure mechanism may include a zipper that extends around at least a second portion of the front frame and a second portion of the back frame.

In one example, the front frame and the back frame may be constructed from one or more elastomers.

In another example, the front and back magnetic strips may be encapsulated within channels within the respective front and back frames.

In yet another example, the closure mechanism may also include a zipper trough formed when the front magnetic strip is magnetically coupled to the back magnetic strip.

The zipper may also include a zipper tape that is stretchable he coupled to at least the second portion of the front frame and the second portion of the back frame.

Further, when the zipper is closed, the stretchable coupling of the zipper tape to the at least the second portion of the front frame and the second portion of the back frame may exert a compressive force that urges the front magnetic strip and the back magnetic strip toward one another.

Additionally, the front magnetic strip in the back magnetic strip may each have a plurality of magnetic elements.

In one aspect, a bag may include an outer shell formed from a water-resistant material. The outer shell may include a front panel, a rear panel, a top sidewall, a bottom sidewall, a left sidewall, and a right sidewall. The bag may additionally include a pair of adjustable strap attached to the outer shell. A closure may extend around a portion of the left sidewall, top sidewall, and right sidewall such that the closure resealably seals an internal pocket within the bag. The bag may additionally include a first opposer element attached to the left sidewall below the closure and a second opposer attached to the right sidewall below the closure. The bag may additionally include a series of loops coupled to the front panel.

In one example, the bag may be a backpack.

In another example, a closure may include a zipper closure.

In another example, the bag may include a first carry handle on the top sidewall, a second carry handle on the left sidewall, and a third carry handle on the right sidewall.

The present disclosure is disclosed above and in the accompanying drawings with reference to a variety of examples. The purpose served by the disclosure, however, is to provide examples of the various features and concepts related to the disclosure, not to limit the scope of the disclosure. One skilled in the relevant art will recognize that numerous variations and modifications may be made to the examples described above without departing from the scope of the present disclosure.

We claim:

1. A bag comprising:

an outer shell comprising a front panel, a rear panel opposite the front panel, a top sidewall, a bottom sidewall, a left sidewall, and a right sidewall, wherein the top sidewall, the bottom sidewall, the left sidewall, and the right sidewall extend between the front panel and the rear panel;

a pair of adjustable straps coupled to the outer shell, wherein the first adjustable strap of the pair of adjustable straps extends from the top sidewall to a lower portion of the left sidewall, and the second adjustable strap of the pair of adjustable straps extends from the top sidewall to a lower portion of the right sidewall;

a first closure extending around a portion of the left sidewall, over a portion of the top sidewall, and around a portion of the right sidewall, wherein the first closure is configured to move from an open position to a closed position to resealably seal a first internal pocket;

a second closure extending around a portion of the front panel, wherein the second closure is configured to move from an open position to a closed position to resealably seal a second internal pocket, the second closure further comprising:

an opening extending into the second internal pocket;

a closure mechanism of the second closure, further comprising:

a first magnetic strip having a first magnetic strip top side and a first magnetic strip bottom side, wherein the first magnetic strip top side is coupled to a first internal surface of the outer shell at a front edge of the opening at a first uppermost seam and the first magnetic strip bottom side is unattached to the outer shell; and a second magnetic strip having a second magnetic strip top side and a second magnetic strip bottom side wherein the second magnetic strip top side is coupled to a second internal surface at a second uppermost seam at a back edge of the opening and the second magnetic strip bottom side is unattached to the outer shell, wherein the first magnetic strip is magnetically attracted to the second magnetic strip to resealably seal the opening; and wherein at least one of the first magnetic strip and the second magnetic strip is hingedly coupled at the respective front and back edges of the opening to allow at least one of the first magnetic strip and the second magnetic strip to rotate about the respective first or second uppermost seams.

2. The bag of claim 1, wherein the bag is a backpack.

3. The bag of claim 1, further comprising:

a flap portion extending from the second closure, the flap portion having a first fastener element; and a second fastener element coupled to the front panel of the outer shell, wherein the outer shell is configured to fold to removably couple the first fastener element to the second fastener element.

4. The bag of claim 3, wherein the first fastener element is configured to be removably coupled to the second fastener element by hook and loop fasteners.

5. The bag of claim 3, wherein the first fastener element and the second fastener element comprise magnets.

6. The bag of claim 1, wherein the first magnetic strip and the second magnetic strip are hingedly coupled at the respective front and back edges of the opening.

7. The bag of claim 1, wherein the first magnetic strip includes a row of magnetic elements.

8. The bag of claim 1, wherein the first magnetic strip includes an array of magnetic elements having two rows of magnetic elements.

9. The bag of claim 1, wherein the first adjustable strap includes a first plurality of fabric loops that extend from an outer surface of the first adjustable strap, and the second adjustable strap includes a second plurality of fabric loops that extend from an outer surface of the second adjustable strap.

10. The bag of claim 9, wherein an outer surface of the front panel includes a third plurality of fabric loops and a fourth plurality of fabric loops.

11. The bag of claim 1, further comprising a carry handle attached to one of the left sidewall or the right sidewall, wherein the carry handle comprises a folded webbing that is connected to a fabric layer and the fabric layer is coupled to a polymeric board.

* * * * *